US009785062B2

(12) United States Patent
Tsurumi et al.

(10) Patent No.: US 9,785,062 B2
(45) Date of Patent: Oct. 10, 2017

(54) POSITIVELY CHARGEABLE SINGLE-LAYER ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventors: Hiroki Tsurumi, Osaka (JP); Eiichi Miyamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/171,467

(22) Filed: Jun. 2, 2016

(65) Prior Publication Data

US 2016/0357118 A1 Dec. 8, 2016

(30) Foreign Application Priority Data

Jun. 8, 2015 (JP) ..... 2015-115791

(51) Int. Cl.
*G03G 5/04* (2006.01)
*G03G 5/06* (2006.01)
*G03G 5/05* (2006.01)

(52) U.S. Cl.
CPC ..... *G03G 5/0614* (2013.01); *G03G 5/0564* (2013.01); *G03G 5/0575* (2013.01); (Continued)

(58) Field of Classification Search
CPC .. G03G 5/0614; G03G 5/0612; G03G 5/0609; G03G 5/0564; G03G 5/0672; G03G 5/0575; G03G 5/0578
See application file for complete search history.

(56) References Cited

FOREIGN PATENT DOCUMENTS

JP H05-158250 A 6/1993
JP H08-015877 A 1/1996

*Primary Examiner* — Thorl Chea
(74) *Attorney, Agent, or Firm* — Studebaker & Brackett PC

(57) ABSTRACT

In a positively chargeable single-layer electrophotographic photosensitive member, a photosensitive layer contains at least a hole transport material, and particles of a first resin. A compound represented by general formula (1) is contained as the hole transport material. In the general formula (1), $R_1$ represents an alkyl group having a carbon number of at least 2 and no greater than 4. $R_2$, $R_3$, $R_4$, $R_5$, and $R_6$ each represent, independently of one another, a hydrogen atom or an alkyl group having a carbon number of at least 1 and no greater than 4. $Ar_1$ and $Ar_2$ each represent, independently of each other, a hydrogen atom or an optionally substituted aryl group having a carbon number of at least 6 and no greater than 20. At least one of $Ar_1$ and $Ar_2$ represents an optionally substituted aryl group having a carbon number of at least 6 and no greater than 20.

(1)

18 Claims, 3 Drawing Sheets

(52) U.S. Cl.
CPC ..... *G03G 5/0578* (2013.01); *G03G 5/0609* (2013.01); *G03G 5/0612* (2013.01); *G03G 5/0672* (2013.01)

POSITIVELY CHARGEABLE SINGLE-LAYER ELECTROPHOTOGRAPHIC PHOTOSENSITIVE MEMBER, PROCESS CARTRIDGE, AND IMAGE FORMING APPARATUS

INCORPORATION BY REFERENCE

The present application claims priority under 35 U.S.C. §119 to Japanese Patent Application No. 2015-115791, filed on Jun. 8, 2015. The contents of this application are incorporated herein by reference in their entirety.

BACKGROUND

The present disclosure relates to a positively chargeable single-layer electrophotographic photosensitive member, a process cartridge, and an image forming apparatus.

An electrophotographic photosensitive member is used in an electrographic image forming apparatus. The electrophotographic photosensitive member includes a photosensitive layer. The photosensitive layer contains for example a charge generating material, a charge transport material (for example, a hole transport material and an electron transport material), and a resin (binder resin) for binding these materials. The electrophotographic photosensitive member including the photosensitive layer is called an organic electrophotographic photosensitive member. The photosensitive layer can contain the charge generating material and the charge transport material in a single layer so that the layer functions for generation and transport of electrical charges. The organic electrophotographic photosensitive member including the single layer is called a single-layer electrophotographic photosensitive member.

A charge transport layer and a charge generating layer are stacked sequentially in the stated order in an example of an organic electrophotographic photosensitive member. The charge generating layer contains a lubricant and a reinforcing material.

In another example of an organic electrophotographic photosensitive member, at least a charge generating layer and a charge transport layer are stacked on a substrate (conductive substrate). The charge transport layer includes organic particulates having a number average particle size of at least 0.05 μm and no greater than 3.0 μm. The organic particulates are contained in form of aggregated particles having a number average particle size of greater than 3.0 μm and less than 10.0 μm.

SUMMARY

A positively chargeable single-layer electrophotographic photosensitive member according to the present disclosure includes a conductive substrate and a photosensitive layer. The photosensitive layer contains at least a charge generating material, a hole transport material, and particles of a first resin. A compound represented by general formula (1) shown below is contained as the hole transport material.

(1)

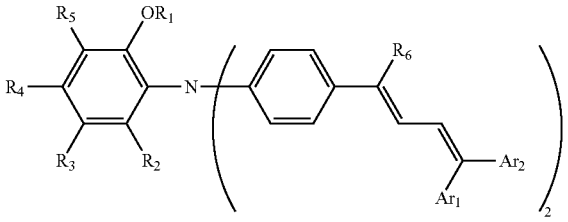

In the general formula (1), $R_1$ represents an alkyl group having a carbon number of at least 2 and no greater than 4. $R_2$, $R_3$. $R_4$, $R_5$, and $R_6$ each represent, independently of one another, a hydrogen atom or an alkyl group having a carbon number of at least 1 and no greater than 4. $Ar_1$ and $Ar_2$ each represent, independently of each other, a hydrogen atom or an optionally substituted aryl group having a carbon number of at least 6 and no greater than 20. At least one of $Ar_1$ and $Ar_2$ represents an optionally substituted aryl group having a carbon number of at least 6 and no greater than 20.

A process cartridge according to the present disclosure includes the positively chargeable single-layer electrophotographic photosensitive member described above.

An image forming apparatus according to the present disclosure includes an image bearing member, a charger, a light exposure section, a development section, and a transfer section. The charger charges a surface of the image bearing member. The light exposure section exposes the charged surface of the image bearing member with light to form an electrostatic latent image on the surface. The development section develops the electrostatic latent image into a toner image. The transfer section transfers the toner image onto a transfer target from the image bearing member. The charger positively charges the surface of the image bearing member. The image bearing member is the positively chargeable single-layer electrophotographic photosensitive member described above.

DETAILED DESCRIPTION

Hereinafter, embodiments of the present disclosure will be described in detail. However, the present disclosure is of course not in any way limited by the following embodiments, and appropriate alterations may be made in practice within the intended scope of the present disclosure. Although description is omitted as appropriate in order to avoid repetition, such omission does not limit the essence of the present disclosure.

In the present description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. Furthermore, the terms "—OMe". "—OEt", and "—OBt" represent a methoxy group, an ethoxy group, and an n-butoxy group, respectively.

Figure 1A:
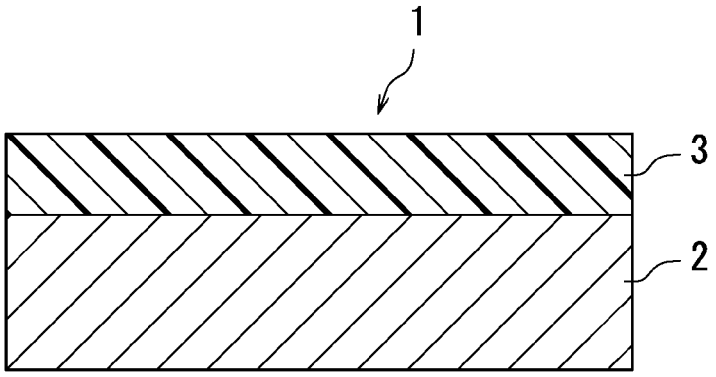
FIGS. 1A-1C each are a schematic cross sectional view illustrating structure of a positively chargeable single-layer electrophotographic photosensitive member according to a first embodiment of the present disclosure.
Figure 1B:
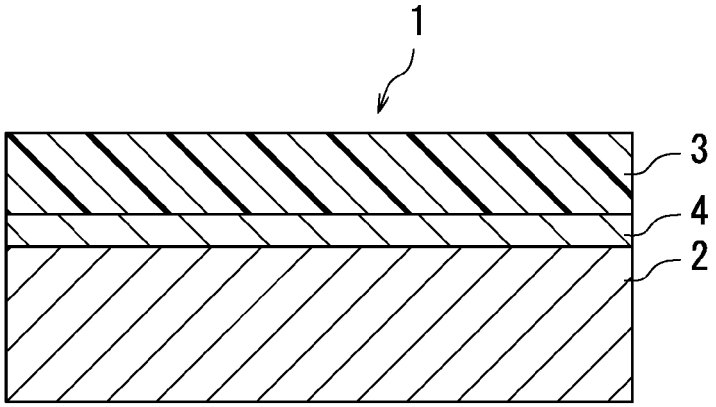
Figure 1C:
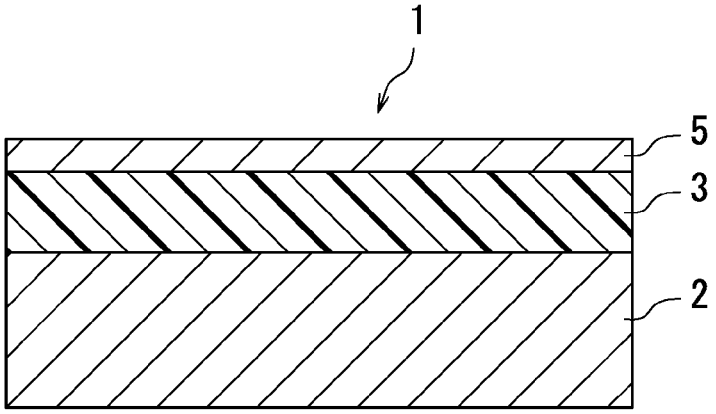

First Embodiment: Positively Chargeable Single-Layer Electrophotographic Photosensitive Member A first embodiment pertains to a positively chargeable single-layer electrophotographic photosensitive member (also referred to below as a "photosensitive member") 1. The photosensitive member 1 according to the present embodiment will be descried below with reference to FIGS. 1A to 1C. FIGS. 1A to 1C each are a schematic cross sectional view illustrating structure of the photosensitive member 1.

The photosensitive member 1 includes a photosensitive layer 3. The photosensitive layer 3 contains at least a charge generating material, a hole transport material, and particles of a first resin. The photosensitive layer 3 contains as the hole transport material, a compound represented by general formula (1) (also referred to below as a compound (1)). Occurrence of transfer memory can be inhibited in the photosensitive member 1. The reason thereof can be inferred as follows.

Transfer memory is first described in order to facilitate understanding the description. An electrophotographic image is formed by an image forming process including the following steps, for example.

Step (1): Charging the surface of an image bearing member that corresponds to the photosensitive member Step (2): Forming an electrostatic latent image on the surface of the photosensitive member by exposing the surface to light while in a charged state Step (3): Developing the electrostatic latent image into a toner image Step (4): Transferring the formed toner image from the image bearing member to a transfer target However, in an image forming process such as described above, transfer memory caused by the transfer step may occur due to the fact that the photosensitive member rotates during use. The following provides a more specific explanation. In the charging step, the surface of the image bearing member is uniformly charged to a specific potential of positive polarity. After the light exposure step and the development step, a transfer bias of opposite polarity (for example, negative polarity) to the aforementioned charging is applied to the image bearing member via the transfer target during the transfer step. Under the influence of the applied transfer bias of the opposite polarity, the potential of a non-exposed region (non-image region) of the surface of the image bearing member may decrease significantly and the decreased potential may be maintained. As a consequence of the decreased potential of the non-exposed region, it may be difficult to charge the non-exposed region to a desired potential of positive polarity in the charging step during a next rotation of the photosensitive member. Furthermore, it is difficult to directly apply the transfer bias to the surface of the photosensitive member even during application of the transfer bias as a consequence of the fact that toner is attached to an exposed region (image region). In the above situation, the potential of the exposed region hardly decreases. Accordingly, the exposed region tends to be charged up to a desired potential of positive polarity in the charging step during a next rotation of the photosensitive member. As a result, the charge potential may differ between the exposed region and the non-exposed region to make it difficult to uniformly charge the surface of the image bearing member to a specific potential of positive polarity. As such, chargeability of the non-exposed region decreases under residual influence of transfer in an imaging step (the image forming process) in a previous rotation of the photosensitive member to cause potential difference in charge potential. This phenomenon is called transfer memory.

Incidentally, as described above, the photosensitive layer 3 of the photosensitive member 1 contains the compound (1) as a hole transport material. The compound (1) has an alkoxy group ($OR_1$ group) having a carbon number of at least 2 and no greater than 4 at an ortho position of a phenyl group. In the above configuration, solubility of the compound (1) to a solvent and compatibility of the compound (1) with a binder resin tend to improve. As a result, the compound (1) tends to uniformly disperse in the photosensitive layer 3. The photosensitive layer 3 in which the compound (1) that is a hole transport material is uniformly dispersed tends to be excellent in hole transportability. In addition, the electron transport material is hardly inhibited from transporting electrons in the photosensitive layer 3 in which a hole transport material is uniformly dispersed, thereby resulting in excellent in electron transportability. As a result, even in a situation in which a transfer bias of opposite polarity is applied to the photosensitive member 1, electrons in the photosensitive layer 3 can quickly move and a less amount of electrons remain in the photosensitive layer 3. As a consequence, occurrence of transfer memory is thought to be inhibited in the photosensitive member 1. In addition, the photosensitive member 1 as above is thought to be excellent in sensitivity characteristics (inhibition of residual potential).

Furthermore, the photosensitive layer 3 of the photosensitive member 1 contains the particles of the first resin. In a configuration in which the photosensitive layer 3 contains the particles of the first resin, the photosensitive member 1 can be favorably charged to a desired potential of positive polarity in the charging step during a next rotation of the photosensitive member 1 for the following reasons. For example, the following advantages can be brought when the photosensitive member 1 is used in an image forming apparatus 6 including a charger 27 of contact type, which will be described later with reference to FIGS. 2 and 3.

A first advantage is as follows. The contact charger 27 charges the photosensitive member 1 by utilizing discharge (gap discharge) induced in a minute gap between the photosensitive member 1 and the charger 27. In a situation in which a gap width between the photosensitive member 1 and the charger 27 is within a predetermined range (for example, at least several micrometers and no greater than 100 micrometers), gap discharge is induced. The photosensitive layer 3 containing the particles of the first resin has a surface having minute projections and recesses. In the above configuration, the minute gap width between the photosensitive member 1 and the charger 27 can be secured even in a region where the charger 27 is in contact with the photosensitive member 1. In the above configuration, a chargeable region in the surface of the photosensitive member 1 tends to increase.

A second advantage is as follows. In a configuration in which the image forming apparatus 6 including the contact charger 27 includes the photosensitive member 1, the surface of the photosensitive member 1 may be exposed to ions having high kinetic energy generated by gap discharge.

However, when the photosensitive layer 3 contains the particles of the first resin, there is a tendency to secure the minute gap width between the photosensitive member 1 and the charger 27 even in the region where the charger 27 is in contact with the photosensitive member 1. As a result, the photosensitive member 1 is hardly influenced by ions having high kinetic energy generated by gap discharge.

For the above advantages, the photosensitive member 1 can be favorably charged up to a desired potential of positive polarity in the charging step during a next rotation of the photosensitive member 1 even in a configuration in which the image forming apparatus 6 including the contact charger 27 includes the photosensitive member 1. As a result, occurrence of transfer memory is thought to be inhibited in the photosensitive member 1.

The photosensitive member 1 will be further described. The photosensitive layer 3 is disposed directly or indirectly on the conductive substrate 2. For example, the photosensitive layer 3 may be disposed directly on the conductive substrate 2 as illustrated in FIG. 1A. Alternatively, for example, an intermediate layer 4 may be disposed between the conductive substrate 2 and the photosensitive layer 3 as illustrated in FIG. 1B. In addition, the photosensitive layer 3 may be disposed as an outermost layer as illustrated in FIGS. 1A and 1B. Alternatively, a protective layer 5 may be disposed on the photosensitive layer 3 as illustrated in FIG. 1C.

The thickness of the photosensitive layer 3 is not limited other than being able to sufficiently function as a photosensitive layer. The photosensitive layer 3 preferably has a thickness of at least 5 μm and no greater than 100 μm, and more preferably at least 10 μm and no greater than 50 μm.

Following describes the conductive substrate 2 and the photosensitive layer 3. Description will be further made about the intermediate layer 4 and a production method of the photosensitive member 1.

<1. Conductive Substrate>

The conductive substrate 2 is not limited specifically other than being useable as a conductive substrate of the photosensitive member 1. It is only required that at least a surface portion of the conductive substrate 2 is made from a conductive material. Examples of the conductive substrate 2 include conductive substrates made from a conductive material and conductive substrates having a coating of a conductive material. Examples of conductive materials that can be used include aluminum, iron, copper, tin, platinum, silver, vanadium, molybdenum, chromium, cadmium, titanium, nickel, palladium, indium, stainless steel, and brass. Any of the conductive materials listed above may be used alone or two or more of the conductive materials listed above may be used in combination as an alloy, for example. Aluminum or an aluminum alloy may be preferable among the conductive materials listed above in terms of excellent charge mobility from the photosensitive layer 3 to the conductive substrate 2.

The shape of the conductive substrate 2 is appropriately determined according to the configuration of the image forming apparatus 6 (see FIGS. 2 and 3), which will be described later in a second embodiment. For example, the conductive substrate 2 may be a sheet-shaped conductive substrate or a drum-shaped conductive substrate. The thickness of the conductive substrate 2 is appropriately determined according to the shape of the conductive substrate 2.

<2. Photosensitive Layer>

Following describes the charge generating material, the hole transport material, and the particle of the first resin that are contained in the photosensitive layer 3. Description will be made in addition about the electron transport material, the binder resin, and an additive each of which may be contained in the photosensitive layer 3 depending on necessity thereof.

<2-1. Charge Generating Material>

The charge generating material is not limited specifically other than being used for a photosensitive member. Examples of charge generating materials that may be used include phthalocyanine-based pigments, perylene pigments, bisazo pigments, dithioketopyrrolopyrrole pigments, metal-free naphthalocyanine pigments, metal naphthalocyanine pigments, squaraine pigments, tris-azo pigments, indigo pigments, azulenium pigments, cyanine pigments, powders of inorganic photoconductive materials (for example, selenium, selenium-tellurium, selenium-arsenic, cadmium sulfide, or amorphous silicon), pyrylium salts, anthanthrone-based pigments, triphenylmethane-based pigments, threne-based pigments, toluidine-based pigments, pyrazoline-based pigments, and quinacridone-based pigments.

Specific examples of phthalocyanine-based pigments include a metal-free phthalocyanine represented by formula (CG-1) and metal phthalocyanines. Specific examples of metal phthalocyanines include a titanyl phthalocyanine represented by formula (CG-2) and a phthalocyanine in which a metal other than titanium oxide is coordinated (for example, V-form hydroxygallium phthalocyanine). The Phthalocyanine-based pigments may be crystalline or non-crystalline. No particular limitations are placed on the crystal structure (for example, α-form, β-form, or Y-form) of the phthalocyanine-based pigments, and phthalocyanine-based pigments having various different crystal structures may be used.

(CG-1)

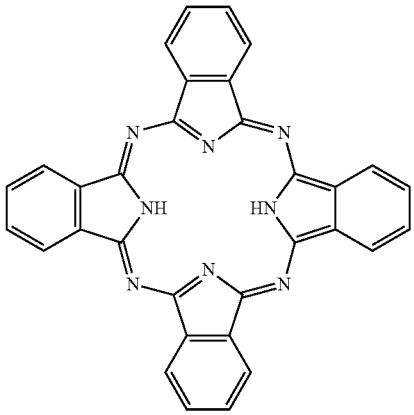

(CG-2)

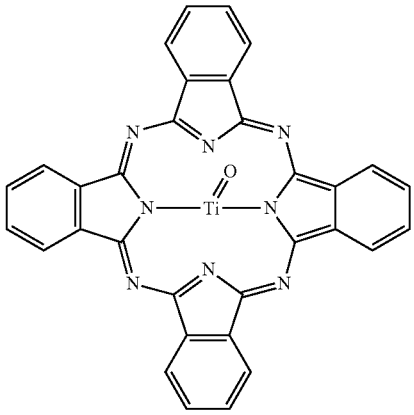

An example metal-free phthalocyanine crystal is metal-free phthalocyanine having a crystal structure of X form (also referred to below as "X-form metal-free phthalocyanine"). Titanyl phthalocyanine that can be used has a crystal structure of α-form, β-form, or Y-form, for example. Titanyl phthalocyanines having the crystal structure of α-form, β-form, and Y-form may be hereinafter referred to as α-form titanyl phthalocyanine, β-form titanyl phthalocyanine, and Y-form titanyl phthalocyanine, respectively. The Y-form titanyl phthalocyanine, which has high quantum yield in a wavelength range of no less than 700 nm, is preferable among titanyl phthalocyanines.

The Y-form titanyl phthalocyanine has a main peak at a Bragg angle (2θ±0.2°) of 27.2° in a CuKα characteristic X-ray diffraction spectrum, for example. The main peak in the CuKα characteristic X-ray diffraction spectrum is a peak having first or second intensity in a Bragg angle (2θ±0.2°) range of at least 3° and no greater than 40°.

(Method of Measuring CuKα Characteristic X-Ray Diffraction Spectrum)

An example method of measuring a CuKα characteristic X-ray diffraction spectrum will be described. A sample (titanyl phthalocyanine) is loaded into a sample holder of an X-ray diffraction spectrometer (for example, RINT (registered Japanese trademark) 1100 produced by Rigaku Corporation), and an X-ray diffraction spectrum is measured using a Cu X-ray tube under conditions of a tube voltage of 40 kV, a tube current of 30 mA, and X-rays of CuKα characteristic having a wavelength of 1.542 Å. The measurement range (2θ) is for example from 3° to 40° (start angle: 3°, stop angle: 40°) and the scanning speed is for example 10°/minute.

Y-form titanyl phthalocyanines as above are divided into three types according to thermoprofiles in a differential scanning calorimetry (DSC) spectrum (specifically, thermoprofiles (A) to (C) designated below).

Thermoprofile (A): One peak appears in a range of at least 50° C. and no greater than 27° C. in a thermoprofile from a DSC other than a peak accompanying vaporization of absorbed water.

Thermoprofile (B): No peak appears in a range of at least 50° C. and no greater than 400° C. in a thermoprofile from a DSC other than to a peak accompanying vaporization of absorbed water.

Thermoprofile (C): No peak appears in a range of at least 50° C. and no greater than 270° C. other than a peak accompanying vaporization of absorbed water and one peak appears in a range of at least 270° C. and no greater than 400° C. in a thermoprofile from a DSC.

(Method of Measuring Differential Scanning Calorimetry Spectrum)

Following describes an example method of measuring a differential scanning calorimetry spectrum. An evaluation sample of a crystal powder of titanyl phthalocyanine is loaded on a sample pan, and a differential scanning calorimetry spectrum is measured using a differential scanning calorimeter (for example, TAS-200, DSC8230D produced by Rigaku Corporation). The measurement range may be at least 40° and no greater than 400° C., for example. The heating rate may be 20° C./min., for example.

Y-form titanyl phthalocyanines having thermoprofiles (B) or (C) are preferable in terms of being excellent in crystalline stability, hardly causing crystal dislocation in an organic solvent, and readily dispersing in the photosensitive layer 3.

A charge generating material having an absorption wavelength in a desired range may be used alone, or two or more charge generating materials may be used in combination. As for image forming apparatuses employing for example a digital optical system (for example, laser beam printers and facsimile machines each employing a semiconductor laser or the like as the light source), a photosensitive member having a sensitivity in a wavelength range of 700 nm or longer is preferred as the photosensitive member 1. For this reason, for example, phthalocyanine-based pigment is preferable and metal-free phthalocyanine or titanyl phthalocyanine is more preferable. Any type of charge generating material may be used alone or a combination of two or more types of charge generating materials may be used in combination.

A photosensitive member 1 included in an image forming apparatus that uses a short-wavelength laser light source (for example, a laser light source having an approximate wavelength of at least 350 nm and no greater than 550 nm) preferably contains an anthanthrone-based pigment or a perylene-based pigment as a charge generating material.

The content of the charge generating material is preferably at least 1.0 parts by mass and no greater than 50 parts by mass relative to 100 parts by mass of the binder resin in the photosensitive layer 3, and more preferably at least 0.5 parts by mass and no greater than 30 parts by mass.

<2-2. Hole Transport Material>

The photosensitive layer 3 contains the compound (1) as a hole transport material. The compound (1) is represented by general formula (1).

(1)

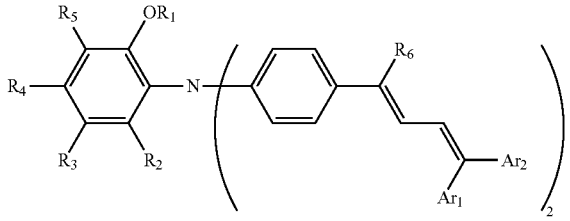

In general formula (1), $R_1$ represents an alkyl group having a carbon number of at least 2 and no greater than 4. $R_2$, $R_3$, $R_4$, $R_5$, and $R_6$ each represent, independently of one another, a hydrogen atom or an alkyl group having a carbon number of at least 1 and no greater than 4. $Ar_1$ and $Ar_2$ each represent, independently of each other, a hydrogen atom or an optionally substituted aryl group having a carbon number of at least 6 and no greater than 20. At least one of $Ar_1$ and $Ar_2$ represents an optionally substituted aryl group having a carbon number of at least 6 and no greater than 20. That is, there is no situation in which $Ar_1$ and $Ar_2$ each are a hydrogen atom.

Examples of alkyl groups having a carbon number of at least 2 and no greater than 4 that can be represented by $R_1$ in general formula (1) include an ethyl group, an n-propyl group, an isopropyl group, an s-butyl group, an n-butyl group, and a t-butyl group.

Examples of alkyl groups having a carbon number of at least 1 and no greater than 4 that can be represented by $R_2$, $R_3$, $R_4$, $R_5$, and $R_6$ include a methyl group, an ethyl group, an n-propyl group, an isopropyl group, an s-butyl group, an n-butyl group, and a t-butyl group. A preferable alkyl group having a carbon number of at least 1 and no greater than 4 may be a methyl group in terms of inhibition of occurrence of transfer memory.

Examples of aryl groups having a carbon number of at least 6 and no greater than 20 that can be represented by $Ar_1$ and $Ar_2$ in general formula (1) include monocyclic aryl groups having a carbon number of at least 6 and no greater than 20 and condensed ring (bicyclic or tricyclic) aryl groups having a carbon number of at least 6 and no greater than 20. An example of monocyclic aryl groups having a carbon number of at least 6 and no greater than 20 may be a phenyl group. An example of bicyclic condensed bicyclic aryl groups having a carbon number of at least 6 and no greater than 20 may be a naphthyl group. Examples of tricycle condensed tricyclic aryl groups having a carbon number of at least 6 and no greater than 20 include an anthryl group and a phenanthryl group. An aryl group having a carbon number of at least 6 and no greater than 14 is preferable and a phenyl group is more preferable as an aryl group having a carbon number of at least 6 and no greater than 20 in terms of inhibition of occurrence of transfer memory.

In general formula (1), an aryl group having a carbon number of at least 6 and no greater than 20 that can be represented by $Ar_1$ and $Ar_2$ may have a substituent. A possible substituent may, for example, be an alkyl group having a carbon number of at least 1 and no greater than 4 or an aryl group having a carbon number of at least 6 and no greater than 20. Examples of alkyl groups having a carbon number of at least 1 and no greater than 4 as a substituent are the same as those listed as the examples of alkyl groups having a carbon number of at least 1 and no greater than 4 that can be represented by $R_2$, $R_3$, $R_4$, $R_5$, and $R_6$. Examples of aryl groups having a carbon number of at least 6 and no greater than 20 as a substituent are the same as those listed as examples of aryl groups having a carbon number of at least 6 and no greater than 20 that can be represented by $Ar_1$ and $Ar_2$. Examples of aryl groups with a substituent having a carbon number of at least 6 and no greater than 20 in a configuration in which $Ar_1$ and $Ar_2$ each represent an aryl group with a substituent having a carbon number of at least 6 and no greater than 20 include tolyl groups, xylyl groups, and mesityl groups.

In terms of inhibition of occurrence of transfer memory, compounds are preferable that is represented by general formula (1) in which $R_1$, $R_2$, $R_3$, $R_4$, $R_5$, $R_6$, $Ar_1$, and $Ar_2$ represent the following groups. $R_1$ represents an alkyl group having a carbon number of at least 2 and no greater than 4. $R_3$, $R_5$, and $R_6$ each represent a hydrogen atom. $R_2$ and $R_4$ each represent, independently of each other, a hydrogen atom or an alkyl group having a carbon number of at least 1 and no greater than 4. One of $Ar_1$ and $Ar_2$ represents an aryl group having a carbon number of at least 6 and no greater than 20, and the other represents a hydrogen atom. For example, where $Ar_2$ represents an aryl group having a carbon number of at least 6 and no greater than 20, $Ar_1$ represents a hydrogen atom. Alternatively, for example, where $Ar_1$ represents an aryl group having a carbon number of at least 6 and no greater than 20, $Ar_2$ represents a hydrogen atom.

Suitable examples of compounds for enabling further inhibition of occurrence of transfer memory include compounds represented by general formula (1) in which $R_1$, $R_2$, $R_3$, $R_4$, $R_5$, $R_6$, $Ar_1$, and $Ar_2$ represent the following groups. $R_1$ represents an alkyl group having a carbon number of 2 or 3. $R_2$, $R_3$, $R_5$, and $R_6$ each represent a hydrogen atom. $R_4$ represents a hydrogen atom or an alkyl group having a carbon number of at least 1 and no greater than 4. One of $Ar_1$ and $Ar_2$ represents an aryl group having a carbon number of at least 6 and no greater than 14, and the other represents a hydrogen atom. For example, where $Ar_2$ represents an aryl group having a carbon number of at least 6 and no greater than 14, $Ar_1$ represents a hydrogen atom. Alternatively, for example, where $Ar_1$ represents an aryl group having a carbon number of at least 6 and no greater than 14, $Ar_2$ represents a hydrogen atom.

Suitable examples of compounds for enabling inhibition of occurrence of transfer memory and improvement in sensitivity characteristics of the photosensitive member 1 include compounds represented by general formula (1) in which $R_1$, $R_2$, $R_3$, $R_4$, $R_5$, $R_6$, $Ar_1$, and $Ar_2$ represent the following groups. $R_1$ represents an alkyl group having a carbon number of 2 or 3. $R_2$ represents an alkyl group having a carbon number of at least 1 and no greater than 4. $R_3$, $R_4$, $R_5$, and $R_6$ each represent a hydrogen atom. One of $Ar_1$ and $Ar_2$ represents an aryl group having a carbon number of at least 6 and no greater than 14, and the other represents a hydrogen atom. For example, where $Ar_2$ represents an aryl group having a carbon number of at least 6 and no greater than 14, $Ar_1$ represents a hydrogen atom. Alternatively, for example, where $Ar_1$ represents an aryl group having a carbon number of at least 6 and no greater than 14, $Ar_2$ represents a hydrogen atom.

Other preferable examples of compounds for enabling inhibition of occurrence of transfer memory and improvement in sensitivity characteristics of the photosensitive member 1 include compounds represented by general formula (1) in which $R_1$, $R_2$, $R_3$, $R_4$, $R_5$, $R_6$, $Ar_1$, and $Ar_2$ represent the following groups. $R_1$ represents an alkyl group having a carbon number of 3 or 4. $R_2$, $R_3$, $R_4$, $R_5$, and $R_6$ each represent a hydrogen atom. One of $Ar_1$ and $Ar_2$ represents an aryl group having a carbon number of at least 6 and no greater than 14, and the other represents a hydrogen atom. For example, where $Ar_2$ represents an aryl group having a carbon number of at least 6 and no greater than 14, $Ar_1$ represents a hydrogen atom. Alternatively, for example, where $Ar_1$ represents an aryl group having a carbon number of at least 6 and no greater than 14, $Ar_2$ represents a hydrogen atom.

Specific examples of compounds (1) include compounds represented by respective formulas (HT-1) to (HT-4). The compounds represented by formulas (HT-1) to (HT-4) shown below may hereinafter be referred to as compounds (HT-1) to (HT-4).

(HT-1)

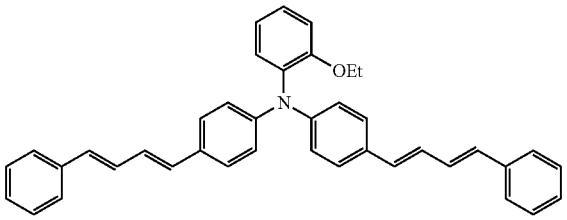

(HT-2)

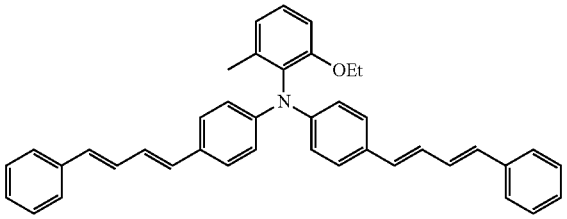

-continued (HT-3)

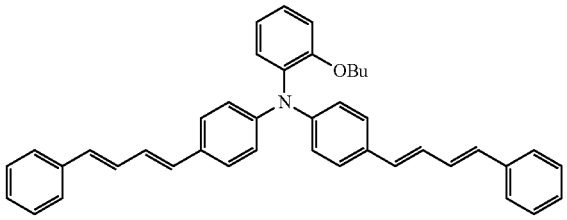

(HT-4)

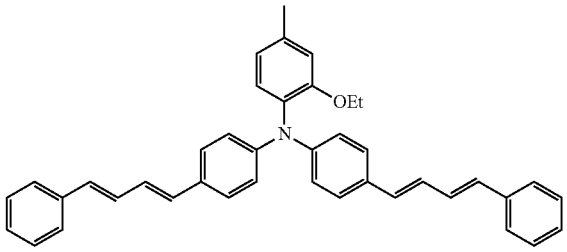

In addition to the compound (1), a hole transport material other than the compound (1) may be used in combination. The other hole transport material is appropriately selected from among known hole transport materials.

The total amount of the hole transport materials is preferably at least 10 parts by mass and no greater than 200 parts by mass relative to 100 parts by mass of the binder resin, more preferably at least 10 parts by mass and no greater than 100 parts by mass, and particularly preferably at least 30 parts by mass and no greater than 70 parts by mass.

The content rate of the compound (1) in the hole transport materials is preferably no less than 80% by mass relative to the total mass of the hole transport materials, more preferably no less than 90% by mass, and particularly preferably 100% by mass.

<2-3. Electron Transport Material>

The photosensitive layer 3 may contain an electron transport material. Examples of electron transport materials that can be used include quinone-based compounds, diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of quinone-based compounds include diphenoquinone-based compounds, azoquinone-based compounds, anthraquinone-based compounds, naphthoquinone-based compounds, nitroanthraquinone-based compounds, and dinitroanthraquinone-based compounds. Any of the electron transport materials listed above may be used alone or two or more of the electron transport materials listed above may be used in combination.

Specific examples of electron transport materials that can be used include compounds represented by respective general formulas (3) to (10). The compounds represented by general formulas (3) to (10) shown below may hereinafter be referred to as compounds (3) to (10).

(3)

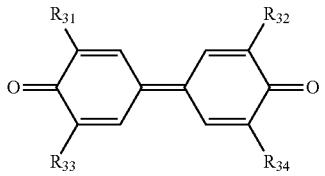

(4)

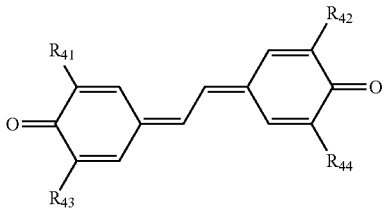

(5)

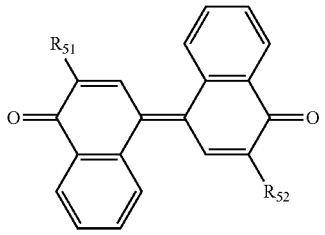

(6)

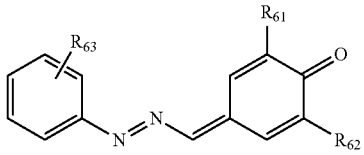

(7)

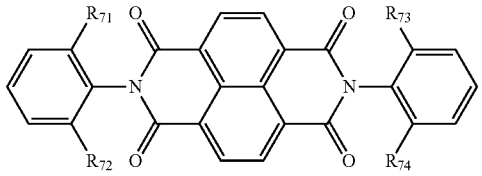

(8)

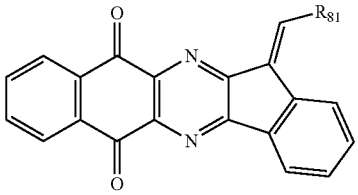

(9)

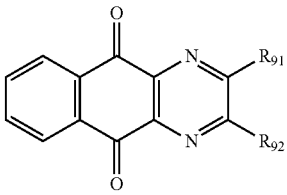

(10)

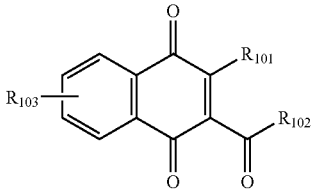

In general formulas (3) to (10), $R_{31}$. $R_{32}$, $R_{33}$, $R_{34}$, $R_{41}$, $R_{42}$, $R_{43}$, $R_{44}$, $R_{51}$, $R_{52}$, $R_{61}$, $R_{62}$, $R_{71}$, $R_{72}$, $R_{73}$, $R_{74}$, $R_{81}$, $R_{91}$, $R_{92}$, $R_{101}$, $R_{102}$, and $R_{103}$ each represent, independently of one another, a hydrogen atom, an optionally substituted alkyl group, an optionally substituted alkenyl group, an optionally substituted alkoxy group, an optionally substituted aralkyl group, an optionally substitute aryl group, or an optionally substituted heterocyclic group. In general formula (6), $R_{63}$ represents a halogen atom, a hydrogen atom, an optionally substituted alkyl group, an optionally substituted alkenyl group, an optionally substituted alkoxy group, an optionally substituted aralkyl group, an optionally substituted aryl group, or an optionally substituted heterocyclic group.

An alkyl group that can be represented by $R_{31}$, $R_{32}$, $R_{33}$, $R_{34}$, $R_{41}$, $R_{42}$, $R_{43}$, $R_{44}$, $R_{51}$, $R_{52}$, $R_{61}$, $R_{62}$, $R_{63}$, $R_{71}$, $R_{72}$, $R_{73}$, $R_{74}$, $R_{81}$, $R_{91}$, $R_{92}$, $R_{101}$, $R_{102}$, or $R_{103}$ in general formulas (3) to (10) may be an alkyl group having a carbon number of at least 1 and no greater than 10, for example. Examples of alkyl groups having a carbon number of at least 1 and no greater than 10 include a methyl group, an ethyl group, an n-propyl group, an isopropyl group, an s-butyl group, an n-butyl group, a tert-butyl group, an n-pentyl group, an isopentyl group, a neopentyl group, a hexyl group, a heptyl group, an octyl group, a nonyl group, and a decyl group. Among the alkyl groups having a carbon number of at least 1 and no greater than 10, an alkyl group having a carbon number of at least 1 and no greater than 6 is preferable. An alkyl group having a carbon number of at least 1 and no greater than 5 is more preferably. A methyl group, an ethyl group, an isopropyl group, a tert-butyl groups, or a 1,1-dimethylpropyl group is particularly preferable. A methyl group, a tert-butyl groups, or a 1,1-dimethylpropyl group is the most preferable. The alkyl group may be a straight chain alkyl group, a branched chain alkyl group, a cycloalkyl group, or an alkyl group that is any combination thereof. The alkyl group may be optionally substituted. Examples of possible substituents of the alkyl group include halogen atoms, a hydroxyl group, alkoxy groups having a carbon number of at least 1 and no greater than 4, and a cyano group. Although no particular limitations are placed on the number of substituents of the alkyl group, the alkyl group preferably has no greater than three substituents.

An alkenyl group that can be represented by $R_{31}$, $R_{32}$, $R_{33}$, $R_{34}$, $R_{41}$, $R_{42}$, $R_{43}$, $R_{44}$, $R_{51}$, $R_{52}$, $R_{61}$, $R_{62}$, $R_{63}$, $R_{71}$, $R_{72}$, $R_{73}$, $R_{74}$, $R_{81}$, $R_{91}$, $R_{92}$, $R_{101}$, $R_{102}$, and $R_{103}$ in general formulas (3) to (10) may for example be an alkenyl group having a carbon number of at least 2 and no greater than 10, preferably an alkenyl group having a carbon number of at least 2 and no greater than 6, and more preferably an alkenyl group having a carbon number of at least 2 and no greater than 4. The alkenyl group may be a straight chain alkenyl group, a branched chain alkenyl group, a cycloalkenyl group, or an alkenyl group that is any combination thereof. The alkenyl group may be optionally substituted. The alkenyl group may for example have a halogen atom, a hydroxyl group, an alkoxy group having a carbon number of at least 1 and no greater than 4, or a cyano group as a substituent. Although no particular limitations are placed on the number of substituents of the alkenyl group, the alkenyl group preferably has no greater than three substituents.

An alkoxy group that can be represented by $R_{31}$, $R_{32}$, $R_{33}$, $R_{34}$, $R_{41}$, $R_{42}$, $R_{43}$, $R_{44}$, $R_{51}$, $R_{52}$, $R_{61}$, $R_{62}$, $R_{63}$, $R_{71}$, $R_{72}$, $R_{73}$, $R_{74}$, $R_{81}$, $R_{91}$, $R_{92}$, $R_{101}$, $R_{102}$, and $R_{103}$ in general formulas (3) to (10) may for example be an alkoxy group having a carbon number of at least 1 and no greater than 10, preferably an alkoxy group having a carbon number of at least 1 and no greater than 6, and more preferably an alkoxy group having a carbon number of at least 1 and no greater than 4. The alkoxy group may be a straight chain alkoxy group, a branched chain alkoxy group, a cyclic alkoxy group, or an alkoxy group that is any combination thereof. The alkoxy group may be optionally substituted. The alkoxy group may for example have a halogen atom, a hydroxyl group, an alkoxy group having a carbon number of at least 1 and no greater than 4, or a cyano group as a substituent. Although no particular limitations are placed on the number of substituents of the alkoxy group, the alkoxy group preferably has no greater than three substituents.

An aralkyl group that can be represented by $R_{31}$, $R_{32}$, $R_{33}$, $R_{34}$, $R_{41}$, $R_{42}$, $R_{43}$, $R_{44}$, $R_{51}$, $R_{52}$, $R_{61}$, $R_{62}$, $R_{63}$, $R_{72}$, $R_{73}$, $R_{74}$, $R_{81}$, $R_{91}$, $R_{92}$, $R_{101}$, $R_{102}$, and $R_{103}$ in general formulas (3) to (10) may for example be an aralkyl group having a carbon number of at least 7 and no greater than 15, preferably an aralkyl group having a carbon number of at least 7 and no greater than 13, and more preferably an aralkyl group having a carbon number of at least 7 and no greater than 12. The aralkyl group may be optionally substituted. Examples of possible substituents of the aralkyl group include halogen atoms, a hydroxyl group, alkyl groups having a carbon number of at least 1 and no greater than 4, alkoxy groups having a carbon number of at least 1 and no greater than 4, a nitro group, a cyano group, aliphatic acyl groups having a carbon number of at least 2 and no greater than 4, a benzoyl group, a phenoxy group, alkoxycarbonyl groups including an alkoxy group having a carbon number of at least 1 and no greater than 4, and a phenoxycarbonyl group. Although no particular limitations are placed on the number of substituents of the aralkyl group, the aralkyl group preferably has no greater than five substituents and more preferably has no greater than three substituents.

Examples of aryl groups that can be represented by $R_{31}$, $R_{32}$, $R_{33}$, $R_{34}$, $R_{41}$, $R_{42}$, $R_{43}$, $R_{44}$, $R_{51}$, $R_{52}$, $R_{61}$, $R_{62}$, $R_{63}$, $R_{71}$, $R_{72}$, $R_{73}$, $R_{74}$, $R_{81}$, $R_{91}$, $R_{92}$, $R_{101}$, $R_{102}$, and $R_{103}$ in general formulas (3) to (10) include a phenyl group, groups resulting from condensation of two or three benzene rings, and groups resulting from single bonding of two or three benzene rings. The number of benzene rings included in the aryl group may be for example at least 1 and no greater than 3 and preferably at least 1 and no greater than 2. Examples of possible substituents of the aryl group include a halogen atom, a hydroxyl group, alkyl groups having a carbon number of at least 1 and no greater than 4, alkoxy groups having a carbon number of at least 1 and no greater than 4, a nitro group, a cyano group, aliphatic acyl groups having a carbon number of at least 2 and no greater than 4, a benzoyl group, a phenoxy group, alkoxycarbonyl groups including an alkoxy group having a carbon number of at least 1 and no greater than 4, and a phenoxycarbonyl group.

Examples of heterocyclic groups that can be represented by $R_{31}$, $R_{32}$, $R_{33}$, $R_{34}$, $R_{41}$, $R_{42}$, $R_{43}$, $R_{44}$, $R_{51}$, $R_{52}$, $R_{61}$, $R_{62}$, $R_{63}$, $R_{71}$, $R_{72}$, $R_{73}$, $R_{74}$, $R_{81}$, $R_{91}$, $R_{92}$, $R_{101}$, $R_{102}$, and $R_{103}$ in general formulas (3) to (10) include: heterocyclic groups that is a five or six member monocyclic ring including at least one hetero atom selected from the group consisting of N, S, and O; heterocyclic groups resulting from condensation of a plurality of such monocyclic rings, and heterocyclic groups resulting from condensation of such a monocyclic ring with a five or six member hydrocarbon ring. In a configuration in which the heterocyclic group has a condensed ring structure, the condensed ring structure preferably includes no greater than three rings. Examples of possible substituents of the heterocyclic group include a halogen atom, a hydroxyl group, alkyl groups having a carbon number of at least 1 and no greater than 4, alkoxy groups having a carbon number of at least 1 and no greater than 4, a nitro group, a cyano group, aliphatic acyl groups having a carbon number of at least 2 and no greater than 4, a benzoyl group, a phenoxy group, alkoxycarbonyl groups including an alkoxy group having a carbon number of at least 1 and no greater than 4, and a phenoxycarbonyl group.

Examples of halogen atoms that can be represented by $R_3$ in general formula (6) include a fluoro group, a chloro group, a bromo group, and an iodo group. The chloro group is preferable as the halogen atom.

The compound (3), (4), (5), or (6) is preferable among the compounds (3) to (10) in terms of inhibition of occurrence of transfer memory. Preferably, $R_{31}$, $R_{32}$, $R_{33}$, $R_{34}$, $R_{41}$, $R_{42}$, $R_{43}$, $R_{44}$, $R_{51}$, $R_{52}$, $R_{61}$, and $R_{62}$ in general formulas (3), (4), (5), and (6) each represent, independently of one another, an alkyl group having a carbon number of at least 1 and no greater than 5 in terms of inhibition of occurrence of transfer memory. $R_{63}$ preferably represents a halogen atom.

Specific examples of the compounds (3) to (10) include compounds represented by formulas (ET-1) to (ET-8), respectively. The compounds represented by formulas (ET-1) to (ET-8) shown below may be hereinafter referred to as compounds (ET-1) to (ET-8).

(ET-1)

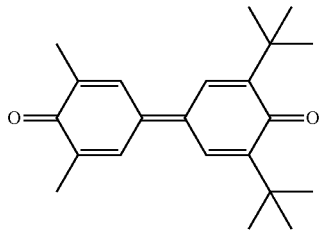

(ET-2)

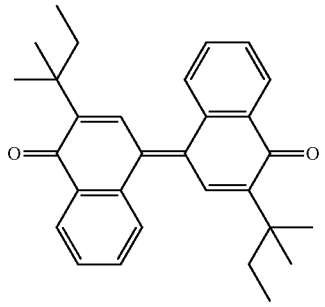

(ET-3)

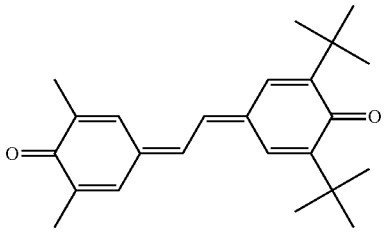

-continued (ET-4)

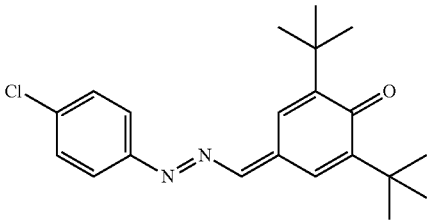

(ET-5)

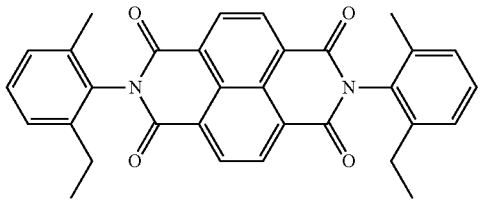

(ET-6)

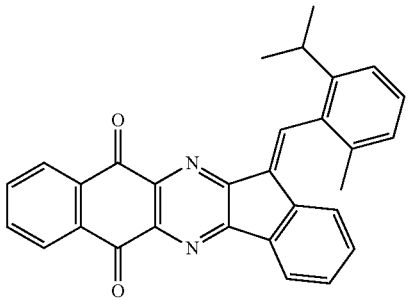

(ET-7)

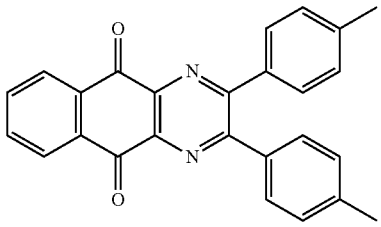

(ET-8)

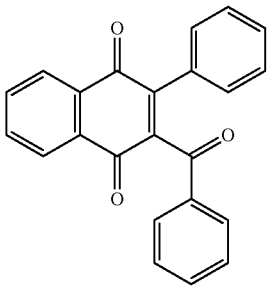

The compounds (ET-1) to (ET-4) are preferable among the compounds (ET-1) to (ET-8) in terms of inhibition of occurrence of transfer memory.

The content of the electron transport material is preferably at least 5 parts by mass and no greater than 100 parts by mass relative to 100 parts by mass of the binder resin, and more preferably at least 10 parts by mass and no greater than 80 parts by mass.

<2-4. Binder Resin>

The photosensitive layer 3 may contain a binder resin. Examples of binder resins that can be contained in the photosensitive layer 3 include thermoplastic resins, thermosetting resins, and photocurable resins. Examples of thermoplastic resins include polycarbonate resins, styrene-based resins, styrene-butadiene copolymers, styrene-acrylonitrile copolymers, styrene-maleate copolymers, styrene-acrylate copolymers, acrylic copolymers, polyethylene resins, ethylene-vinyl acetate copolymers, chlorinated polyethylene resins, polyvinyl chloride resins, polypropylene resins, ionomers, vinyl chloride-vinyl acetate copolymers, alkyd resins, polyamide resins, urethane resins, polyarylate resins, polysulfone resins, diallyl phthalate resins, ketone resins, polyvinyl butyral resins, polyether resins, and polyester resins. Examples of thermosetting resins include silicone resins, epoxy resins, phenolic resins, urea resins, melamine resins, and other crosslinkable thermosetting resins. Examples of photocurable resins include epoxy acrylate resins and urethane-acrylate copolymers. Any of the binder resins listed above may be used alone or two or more of the binder resins listed above may be used in combination.

Among the binder resins listed above, a polycarbonate resin is preferable in terms of easy production of the photosensitive layer 3 having an excellent balance in terms of processability, mechanical properties, optical properties, and abrasion resistance. Examples of polycarbonate resins include bisphenol Z polycarbonate resins, bisphenol B polycarbonate resins, bisphenol CZ polycarbonate resins, bisphenol C polycarbonate resins, and bisphenol A polycarbonate resins. Among of the above polycarbonate resins, a bisphenol Z polycarbonate resin is preferable in terms of inhibition of occurrence of transfer memory.

A specific example of bisphenol Z polycarbonate resins may be a second resin shown below. The second resin that is a binder resin is preferably different from the first resin which will be described later. The second resin does not have a particle shape in the photosensitive layer 3 unlike the first resin. The second resin is represented by general formula (2). The second resin represented by general formula (2) may be hereinafter referred to as a resin (2).

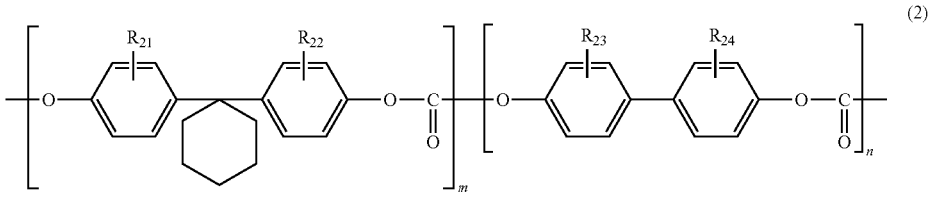

(2)

In general formula (2), $R_{21}$, $R_{22}$, $R_{23}$, and $R_{24}$ each represent, independently of one another, a hydrogen atom or an alkyl group having a carbon number of at least 1 and no greater than 3.

Examples of alkyl groups having a carbon number of at least 1 and no greater than 3 that can be represented by $R_{21}$, $R_{22}$, $R_{23}$, and $R_{24}$ in general formula (2) include a methyl group, an ethyl group, an n-propyl group, and an isopropyl group. Among of the alkyl groups listed above, a methyl group is preferable in terms of inhibition of occurrence of transfer memory.

In general formula (2), m+n=1.00 and 0.00<m≤1.00. That is, m is greater than 0.00) and at least 1.00. The resin (2) is formed from a repeating unit represented by general formula (2a) and a repeating unit represented by general formula (2b). The repeating unit represented by general formula (2a) may be hereinafter referred to as a "repeating unit (2a)", and the repeating unit represented by general formula (2b) may be hereinafter referred to a "repeating unit (2b). In general formula (2), m represents a rate of the number of moles of the repeating unit (2a) relative to a total number of moles of the respective numbers of moles of the repeating unit (2a) and the repeating unit (2b) in the resin (2). Also, n represents a rate of the number of moles of the repeating unit (2b) relative to the total number of moles of the respective numbers of moles of the repeating unit (2a) and the repeating unit (2b) in the resin (2). Note that the resin (2) is formed from only the repeating unit (2a) where m=1.00. One preferable aspect in terms of inhibition of occurrence of transfer memory is that m=1.00 and n=0.00. Another preferable aspect in terms of inhibition of occurrence of transfer memory is that 0.50≤m≤0.70. It is more preferable that 0.55≤m≤0.65. That is, m is preferably at least 0.50 and no greater than 0.70, and more preferably at least 0.55 and no greater than 0.65.

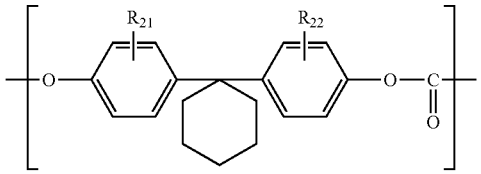

(2a)

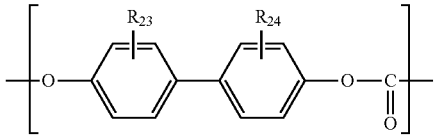

(2b)

In general formulase (2a) and (2b), $R_{21}$, $R_{22}$, $R_{23}$, and $R_{24}$ each are identical with $R_{21}$, $R_{22}$, $R_{23}$, and $R_{24}$ in general formula (2), respectively.

By for example measuring the resin (2) using a nuclear magnetic resonance (NMR) spectrometer, m and n are calculated. Specifically, when a ratio between a peak unique to the repeating unit (2a) and a peak unique to the repeating unit (2b) that appear in a NMR spectrum is calculated, m and n can be obtained.

The resin (2) may be a random copolymer, an alternating copolymer, a periodic copolymer, or a block copolymer, for example. The random copolymer is a copolymer in which the repeating units (2a) and (2b) are arranged at random. The alternating copolymer is a copolymer in which the repeating units (2a) and (2b) are arranged alternately. The periodic copolymer is a copolymer in which one or more repeating units (2a) and one or more repeating units (2b) are arranged periodically. The block copolymer is a copolymer in which a block of a plurality of repeating units (2a) and a block of a plurality of repeating unites (2b) are arranged.

Preferable examples of the resin (2) that are especially advantageous in inhibition of occurrence of transfer memory include resins represented by general formula (2) in which $R_{21}$, $R_{22}$, $R_{23}$, and $R_{24}$ represent the following groups and m and n are as follows. $R_{21}$ and $R_{22}$ each represent, independently of each other, a hydrogen atom or an alkyl group having a carbon number of at least 1 and no greater than 3, $R_{23}$ and $R_{24}$ each represent a hydrogen atom. Furthermore, $m+n=1.00$ and $0.50 \leq m \leq 0.70$ (preferably, $0.55 \leq m \leq 0.65$).

Preferable examples of compounds that are especially advantageous in inhibition of occurrence of transfer memory include resins represented by general formula (2) in which $R_{21}$ and $R_{22}$ represent the following groups and m and n are as follows. $R_{21}$ and $R_{22}$ each represent a hydrogen atom. Furthermore, m=1.00 and n=0.00.

Specific examples of compounds of the resin (2) include resins represented by formulas (Resin-1) to (Resin-8). Note that each subscript affixed to repeating units in formulas (Resin-1) and (Resin-2) corresponds to the number represented by m in general formula (2). Subscripts affixed to respective repeating units in formulas (Resin-3) to (Resin-8) correspond to the respective numbers represented by m and n in general formula (2).

(Resin-1)

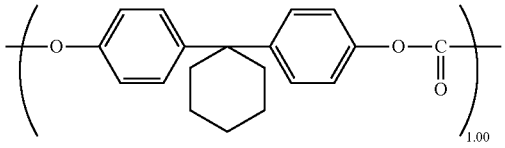

(Resin-2)

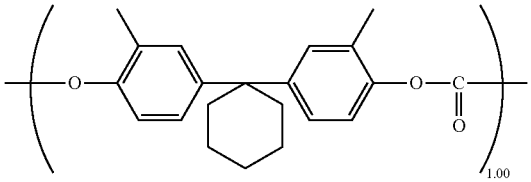

(Resin-3)

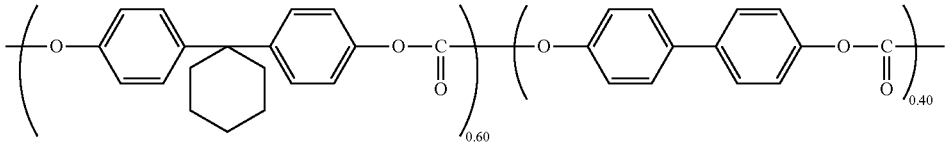

(Resin-4)

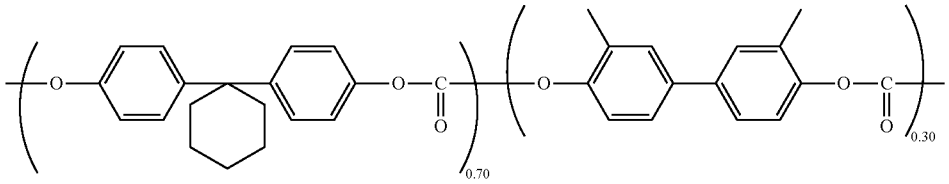

(Resin-5)

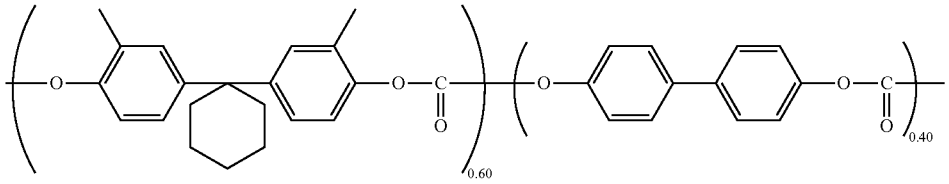

(Resin-6)

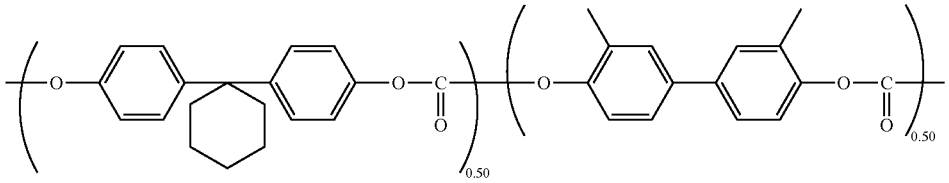

(Resin-7)

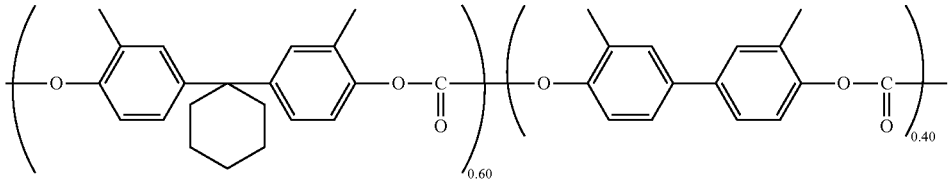

(Resin-8)

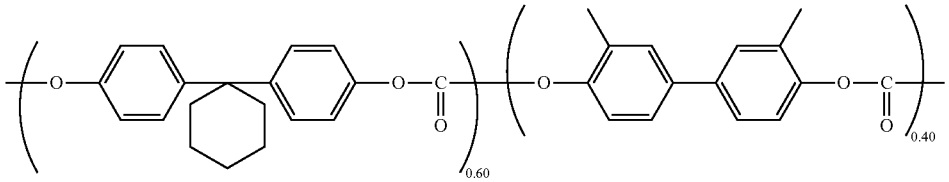

Following describes a method of producing a polycarbonate resin. An example method of producing a polycarbonate resin may be interface condensation polymerization of a diol compound and dihalogenated carbonyl that are used for forming the respective repeating units of the polycarbonate resin, which is generally called a phosgene method. Another example method of producing a polycarbonate resin is an ester exchange reaction between a diol compound and diphenyl carbonate. Note that the method of producing a polycarbonate resin is not limited specifically. The polycarbonate resin may be produced through appropriate selection from among the phosgene method, the ester exchange reaction, and any other known methods.

A situation in which the resin (2) is produced by the phosgene method will be described below as an example. The resin (2) is produced by interface polycondensation of a compound represented by general formula (2am) and a compound represented by general formula (2bm). Hereafter, a compound represented by general formula (2am) may be referred to as a compound (2am) and a compound represented by general formula (2bm) may be referred to as a compound (2bm). The additive amount of the compound (2am) is preferably greater than 0 mol % (m=0.00) and no greater than 100 mol % (m=1.00) relative to the total number of moles of the respective numbers of moles of the compounds (2am) and (2bm). Note that in situation in which the additive amount of the compound (2am) is 100 mol % relative to the total the number of moles of the respective numbers of moles of the compounds (2am) and (2bm), the compound (2bm) is not used in interface polycondensation.

(2am)

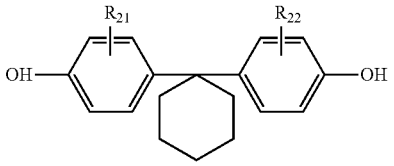

(2bm)

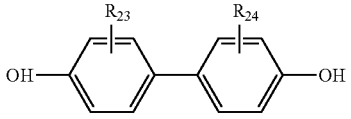

In general formulas (2am) and (2bm), $R_{21}$, $R_{22}$, $R_{23}$, and $R_{24}$ are identical with $R_{21}$, $R_{22}$, $R_{23}$, and $R_{24}$ in general formula (2), respectively.

The molecular weight of the binder resin is preferably at least 40,000 in terms of viscosity average molecular weight, and more preferably at least 40,000 and no greater than 52,500). In a configuration in which the viscosity average molecular weight of the binder resin is no less than 40.000, the binder resin can be easily improved in abrasion resistance and the photosensitive layer 3 is hardly worn out. Further, in a configuration in which the molecular weight of the binder resin is no greater than 52,500, the binder resin can be easily solved in a solvent for formation of the photosensitive layer 3 so that the viscosity of an application liquid for photosensitive layer formation cannot become excessively high. As a result, the photosensitive layer 3 can be easily formed.

<2-5. Particles of First Resin>

The photosensitive layer 3 contains the particles of the first resin. Examples of resins as the first resin that can be used for forming the particles of the first resin include silicone resins, melamine resins (for example, a melamine formaldehyde condensate), benzoguanamine resins (for example, a benzoguanamine condensate), polyphenylene sulfide resins, and acrylic resins. A silicone resin, a melamine resin, a benzoguanamine resin, or a polyphenylene sulfide resin is preferable as the first resin in terms of inhibition of occurrence of transfer memory. A silicone resin, a melamine resin, or a benzoguanamine resin is more preferable. A silicone resin or a benzoguanamine resin is further more preferable.

The particles of the first resin preferably have a volume median diameter ($D_{50}$) of at least 0.05 μm and no greater than 5.00 μm more preferably at least 0.20 μm and no greater than 5.00 μm, and further more preferably at least 0.30 μm and no greater than 5.00 μm. In a configuration in which the volume median diameter of the particles of the first resin falls within such a range, transfer memory can be easily inhibited from occurring. Further, the photosensitive layer 3 can hardly worn out and the photosensitive member 1 can be easily improved in scratch resistance.

The volume median diameter of the particles of the first resin can be measured using a precision particle size distribution analyzer (Coulter Counter Multisizer 3 produced by Beckman Coulter, Inc.). Note that the volume median diameter herein means a median diameter of particles calculated in terms of volume by Coulter Counter.

The content rate of the particles of the first resin is preferably no greater than 25.0% by mass relative to a total mass of the photosensitive layer 3 in terms of inhibition of occurrence of transfer memory, more preferably at least 0.5% by mass and no greater than 15.0% by mass, further more preferably at least 2.5% by mass and no greater than 10.0% by mass, particularly preferably at least 5.0% by mass and no greater than 9.5% by mass, and the most preferably at least 4.0% by mass and no greater than 9.0% by mass. In a configuration in which the content rate of the particles of the first resin is no greater than 25.0% by mass, defects in image quality (for example, a stain such as a black spot), which are originated from projections and recesses in the surface of the photosensitive member 1 that are formed by the resin particles, can be hardly caused.

The particles of the first resin each preferably have a spherical shape in order to inhibit abrasion of the photosensitive layer 3. The particles of the first resin are preferably contained in the photosensitive layer 3 while maintaining the spherical shape.

The particles of the first resin in the photosensitive layer 3 can be for example observed by the following method. A thin sample piece having a thickness of 200 nm is cut out from the photosensitive layer 3 for sectional observation of the photosensitive layer 3 using a microtome (EM UC6 produced by Leica Microsystems K.K.) in which a diamond knife is set. The resultant thin sample piece is observed at respective magnifications of 3,000× and 10,000× using a transmission electron microscope (TEM) (JSM-6700F produced by JEOL Ltd.), and a TEM photograph of the cross-section of the photosensitive layer 3 is taken. Through the above, the particles of the first resin in the photosensitive layer 3 can be observed.

<2-6. Additives>

The photosensitive layer 3 may optionally contain various additives within a range not adversely affecting the electrophotographic characteristics of the photosensitive member 1. Examples of additives that may be used include antidegradants (specific examples include antioxidants, radical scavengers, singlet quenchers, and ultraviolet absorbing agents), softeners, surface modifiers, extenders, thickeners, dispersion stabilizers, waxes, acceptors, donors, surfactants, plasticizers, sensitizers, and leveling agents. Examples of antioxidants include hindered phenol, hindered amine, paraphenylenediamine, arylalkane, hydroquinone, spirochromane, spiroindanone, and their derivatives as well as organosulfur compounds, and organophosphorous compounds.

<3. Intermediate Layer>

The intermediate layer 4 (especially, an undercoat layer) is located for example between the conductive substrate 2 and the photosensitive layer 3 in the photosensitive member 1. The intermediate layer 4 contains inorganic particles and a resin for intermediate layer use (intermediate layer resin), for example. It is thought that the presence of the intermediate layer 4 can allow electric current generated at light exposure of the photosensitive member 1 to smoothly flow while maintaining an insulating state to such an extent that occurrence of leakage can be inhibited, thereby resulting in suppression of resistance increase.

Examples of inorganic particles that may be used include particles of metals (for example, aluminum, iron, or copper), particles of metal oxides (for example, titanium oxide, alumina, zirconium oxide, tin oxide, or zinc oxide), and particles of non-metal oxides (for example, silica). Any type of inorganic particles listed above may be used alone or two or more types of inorganic particles listed above may be used in combination.

The intermediate layer resin is not limited specifically other than being usable as a resin for forming the intermediate layer 4.

The intermediate layer 4 may optionally contain various additives within a range not adversely affecting the electrophotographic characteristics of the photosensitive member 1. The additives are the same as those for the photosensitive layer 3.

<4. Photosensitive Member Production Method>

The following describes an example method of producing the photosensitive member 1. The method of producing the photosensitive member 1 involves photosensitive layer formation. In the photosensitive layer formation, an application liquid for photosensitive layer formation is applied onto the conductive substrate 2 and a solvent contained in the applied application liquid for photosensitive layer formation is removed to form the photosensitive layer 3. The application liquid for photosensitive layer formation contains at least a charge generating material, the compound (1) as a hole transport material, the particles of the first resin, and the solvent. The application liquid for photosensitive layer formation is prepared by solving or dispersing the charge generating material, the compound (1), and the particles of the first resin into the solvent. The application liquid for photosensitive layer formation may optionally contain an electron transport material, a binder resin, and various types of additives depending on necessity thereof.

The solvent contained in the application liquid for photosensitive layer formation is not limited specifically as long as respective components contained in the application liquid for photosensitive layer formation can be solved or dispersed therein. Examples of solvents that can be used include alcohols (for example, methanol, ethanol, isopropanol, and butanol), aliphatic hydrocarbons (for example, n-hexane, octane, and cyclohexane), aromatic hydrocarbons (for example, benzene, toluene, and xylene), halogenated hydrocarbons (for example, dichloromethane, dichloroethane, carbon tetrachloride, and chlorobenzene), ethers (for example, dimethyl ether, diethyl ether, tetrahydrofuran, ethylene glycol dimethyl ether, and diethylene glycol dimethyl ether), ketones (for example, acetone, methyl ethyl ketone, and cyclohexanone), esters (for example, ethyl acetate and methyl acetate), dimethyl formaldehyde, N,N-dimethylformamide (DMF), and dimethyl sulfoxide. Any of these solvents listed above may be used alone or two or more of the solvents listed above may be used in combination. A solvent other than halogenated hydrocarbons is preferable among the solvents listed above in order to improve workability in production of the photosensitive member 1.

The application liquid for photosensitive layer formation is prepared by mixing the respective components and dispersing the resultant mixture into the solvent. Mixing or dispersion can for example be performed using a bead mill, a roll mill, a ball mill, an attritor, a paint shaker, or an ultrasonic disperser.

The application liquid for photosensitive layer formation may contain for example a surfactant or a leveling agent in order to improve dispersibility of the respective components or surface smoothness of the respective layers to be formed.

Any method is adoptable for coating of the application liquid for photosensitive layer formation other than being a method that can uniformly coat the application liquid for photosensitive layer formation on, for example, the conductive substrate 2. The coating method may be dip coating, spray coating, spin coating, or bar coating, for example.

Any method is adoptable for removal of the solvent contained in the application liquid for photosensitive layer formation other than being a method that can evaporate the solvent in the application liquid for photosensitive layer formation. The method for removing the solvent may be heating, depressurization, or a combination of heating and depressurization, for example. A more specific example method may be heat treatment (hot-air drying) using a high-temperature dryer or a reduced pressure dryer. The heat treatment is for example performed for at least 3 minutes and no greater than 120 minutes at a temperature of at least 40° C. and no greater than 150° C.

Note that the method of producing the photosensitive member 1 may additionally involve either or both of formation of the intermediate layer 4 and formation of the protective layer 5 depending on necessity thereof. Known methods are appropriately selected for respective formation of the intermediate layer 4 and the protective layer 5.

The photosensitive member 1 may be used as an image bearing member in the image forming apparatus 6 including a charger 27 that applies direct current voltage to the image bearing member while in contact with the image bearing member. Note that the image forming apparatus 6 will be described later in the second embodiment.

The photosensitive member 1 according to the first embodiment has been described so far with reference to FIGS. 1A to 1C. Transfer memory can be inhibited from occurring through the use of the photosensitive member 1 according to the present embodiment.

Second Embodiment: Image Forming Apparatus

The second embodiment pertains to the image forming apparatus 6. The following describes the image forming apparatus 6 according to the present embodiment with reference to FIGS. 2 and 3.

The image forming apparatus 6 includes the photosensitive member 1 that is an image bearing member. In the above configuration, induction of a defect in image quality (for example, image ghost) due to the presence of transfer memory can be inhibited in the image forming apparatus 6. The reason thereof can be inferred as follows.

For the convenience sake, a defect in image quality due to the presence of transfer memory will be described first. As has been already described, once transfer memory occurs, the potential tends to decrease in a surface region of the photosensitive member 1 that cannot reach a desired potential in the charging step during in a next rotation of the photosensitive member 1, when compared with a region thereof that can reach the desired potential in the charging step during in the next rotation of the photosensitive member 1. Specifically, in the surface of the photosensitive member 1, the potential tends to decrease in a non-exposed region when compared with an exposed region in a previous rotation of the photosensitive member 1. For this reason, the non-exposed region in the previous rotation of the photosensitive member 1 may decrease in potential when compared with the exposed region in the previous rotation thereof. As such, the non-exposed region in the previous rotation tends to attract positively charged toner. As a result, an image that reflects the non-exposed region (non-imaged portion) in the previous rotation is liable to be formed in a next rotation. Such a defect in image quality, which is formation of an image reflecting a non-imaged portion in a previous rotation of the photosensitive member 1, is a defect in image quality produced due to the presence of transfer memory.

Occurrence of transfer memory can be inhibited in the photosensitive member 1 according to the first embodiment, as described above. Therefore, induction of a defect in image quality due to the presence of transfer memory can be inhibited in the image forming apparatus 6 that includes the photosensitive member 1 according to the first embodiment.

Figure 2:
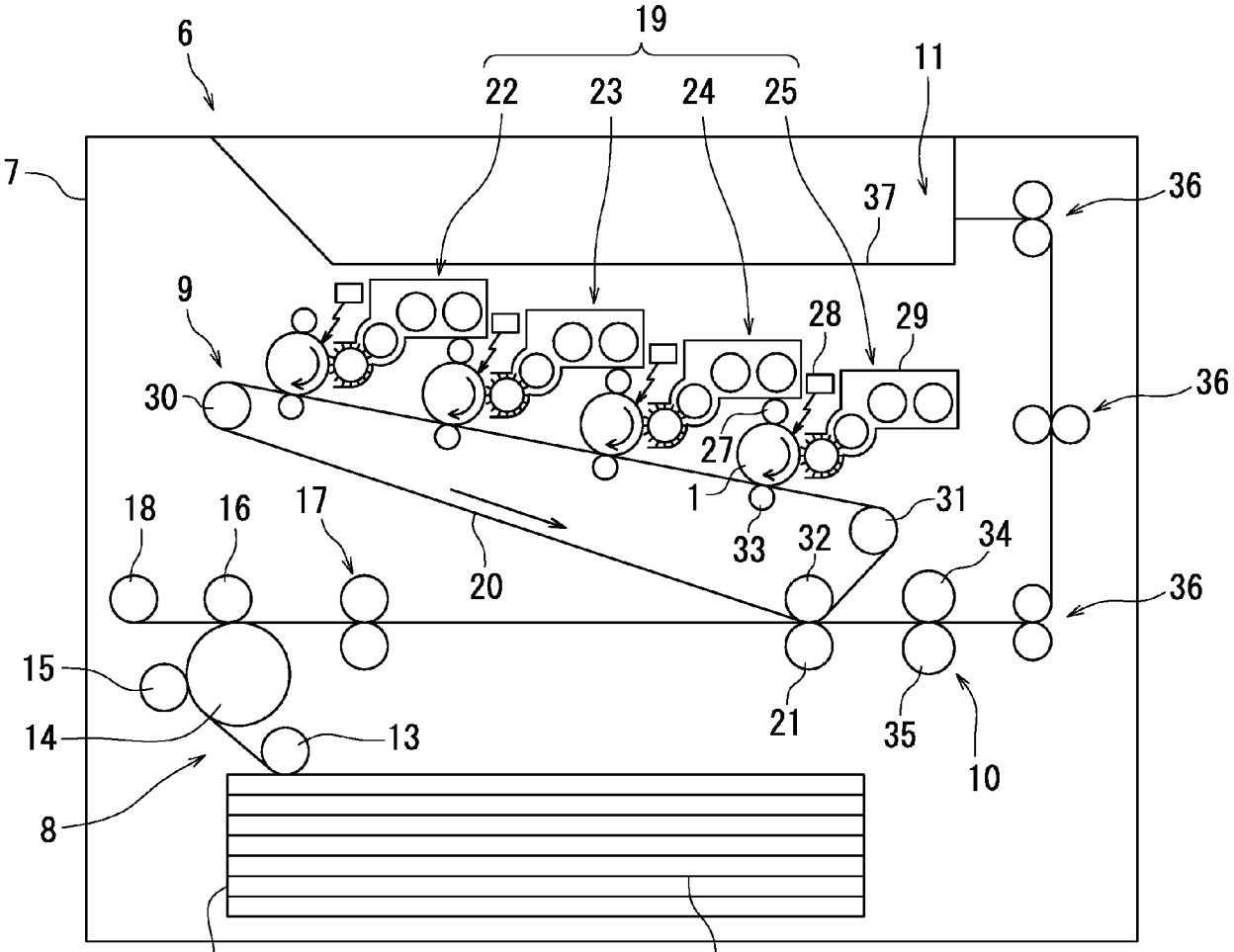
FIG. 2 roughly illustrates an example of an image forming apparatus according to a second embodiment of the present disclosure.

An example configuration in which the image forming apparatus 6 adopts an intermediate transfer process will be described below with reference to FIG. 2. Note that a configuration in which the image forming apparatus 6 adopts a direct transfer process will be described later. FIG. 2 roughly illustrates an example configuration of the image forming apparatus 6.

The image forming apparatus 6 includes a photosensitive member 1 that is an image bearing member, a charger 27, a light exposure section 28, a development section 29, and a transfer section. The photosensitive member 1 is equivalent to the photosensitive member 1 described in the first embodiment. The charger 27 charges the surface of the photosensitive member 1. Charging polarity of the charger 27 is positive. The light exposure section 28 exposes the charged surface of the photosensitive member 1 to form an electrostatic latent image on the surface of the photosensitive member 1. The development section 29 develops the electrostatic latent image into a toner image. The transfer section transfers the toner image from the photosensitive member 1 to a transfer target. In the configuration in which the image forming apparatus 6 adopts the intermediate transfer process, the transfer section is equivalent to primary transfer rollers 33 and a secondary transfer roller 21. The transfer target is equivalent to an intermediate transfer belt 20 and a recording medium (for example, paper P).

No particular limitations are placed on the image forming apparatus 6 other than being an electrophotographic image forming apparatus. The image forming apparatus 6 may for example be a monochrome image forming apparatus or a color image forming apparatus. The image forming apparatus 6 may be a tandem color image forming apparatus that forms toner images of different colors using different color toners.

The following describes an example in which the image forming apparatus 6 is a tandem color image forming apparatus. The image forming apparatus 6 includes a plurality of the photosensitive members 1 and a plurality of the development sections 29 that are disposed side by side in a predetermined direction. The development sections 29 are each disposed opposite to a corresponding one of the photosensitive members 1. The development sections 29 each include a development roller. The development roller carries and conveys toner to supply the toner to the surface of the corresponding photosensitive member 1.

As illustrated in FIG. 2, the image forming apparatus 6 has a box shaped apparatus housing 7. A paper feed section 8, an image forming section 9, and a fixing section 10 are disposed in the apparatus housing 7. The paper feed section 8 feeds paper P. The image forming section 9 transfers a toner image based on image data to the paper P fed from the paper feed section 8 while conveying the paper P. The fixing section 10 fixes the toner image that has been transferred to the paper P by the image forming section 9 and unfixed yet onto the paper P. A paper ejection section 11 is provided on top of the apparatus housing 7. The paper ejection section 11 ejects the paper P after the paper P has been subjected to fixing by the fixing section 10.

The paper feed section 8 includes a paper feed cassette 12, a first pick-up roller 13, paper feed rollers 14, 15, and 16, and a pair of registration rollers 17. The paper feed cassette 12 is attachable to and detachable from the apparatus housing 7. Various sizes of paper P can be loaded into the paper feed cassette 12. The first pick-up roller 13 is located above a left-hand side of the paper feed cassette 12. The first pick-up roller 13 picks up paper P one sheet at a time from the paper feed cassette 12 in which the paper P is loaded. The paper feed rollers 14, 15, and 16 convey the paper P picked up by the first pick-up roller 13. The pair of registration rollers 17 temporarily halts the paper P that is conveyed by the paper feed rollers 14, 15, and 16, and subsequently feeds the paper P to the image forming section 9 at a specific timing.

The paper feed section 8 further includes a manual feed tray (not illustrated) and a second pick-up roller 18. The manual feed tray is mounted on the left side surface of the apparatus housing 7. The second pick-up roller 18 picks up paper P that is loaded on the manual feed tray. The paper P picked up by the second pick-up roller 18 is conveyed by the paper feed roller 16 and fed to the image forming section 9 at a specific timing by the pair of registration rollers 17.

The image forming section 9 includes an image forming unit 19, an intermediate transfer belt 20, and a secondary transfer roller 21. The image forming unit 19 performs primary transfer of a toner image onto a surface of the intermediate transfer belt 20 (i.e., a surface in contact with the photosensitive member 1). The toner image that is subjected to primary transfer is formed based on image data that is transmitted from a higher-level device such as a computer. The secondary transfer roller 21 performs secondary transfer of the toner image on the intermediate transfer belt 20 to paper P that is fed from the paper feed cassette 12.

The image forming unit 19 is provided with a yellow toner supply unit 25, a magenta toner supply unit 24, a cyan toner supply unit 23, and a black toner supply unit 22 that are disposed in the stated order from upstream (right side in FIG. 2) to downstream in terms of a circulation direction of the intermediate transfer belt 20 with reference to the yellow toner supply unit 25. The photosensitive members 1 are each disposed at a central position in a corresponding one of the toner supply units 22, 23, 24, and 25. The photosensitive members 1 are rotatable in an arrow direction (i.e., clockwise). Note that the units 22, 23, 24, and 25 may each be a process cartridge detachable from the main body of the image forming apparatus 6, which will be described later.

The charger 27, the light exposure section 28, and the development section 29 are disposed around each of the photosensitive members 1 in the stated order from upstream to downstream in terms of a rotation direction of the corresponding photosensitive member 1 with reference to the charger 27.

A static eliminator (not illustrated) and a cleaner (not illustrated) may be disposed upstream of the charger 27 in terms of the rotation direction of the corresponding photosensitive member 1. Once primary transfer of toner images onto the intermediate transfer belt 20 is complete, the static eliminator eliminates static electricity from the circumferential surface of the corresponding photosensitive member 1. After the circumferential surface of the photosensitive member 1 has been cleaned by the cleaner and has been eliminated by the static eliminator, the circumferential surface of the photosensitive member 1 returns to a position corresponding to the charger 27 and a new charging process is performed. In a configuration in which the image forming apparatus 6 includes either or both of the cleaners and the static eliminators, the charger 27, the light exposure section 28, the development section 29, the primary transfer rollers 33, the cleaner, and the static eliminator are disposed in the stated order from upstream to downstream in terms of the rotation direction of the corresponding photosensitive member 1 with reference to the charger 27.

The charger 27 charges the surface of the corresponding photosensitive member 1 as has been already described. More specifically, the charger 27 positively charges the circumferential surface (surface) of the photosensitive member 1 as the photosensitive member 1 rotates in the arrow direction. That is, the charging polarity of the charger 27 is positive. The charger 27 may be a non-contact charger or a contact charger. A non-contact charger 27 applies voltage to the photosensitive member 1 while out of contact with the photosensitive member 1. When the charger 27 is a non-contact charger, the charger 27 may be for example a corona discharge charging device and, more specifically, may be for example a corotron charger or a scorotron charger. A contact charger 27 applies voltage to the photosensitive member 1 while in contact with the photosensitive member 1. When the charger 27 is a contact charger, the charger 27 may be for example a contact (proximity) discharge charging device and, more specifically, may be for example a charging roller or a charging brush.

The charging roller may for example be rotationally driven by rotation of the photosensitive member 1 while in contact with the photosensitive member 1. At least a surface section of the charging roller may for example be formed from a resin. More specifically, the charging roller may include for example a metal core bar supported to be axially rotatable, a resin layer coating the metal core bar, and a voltage application section for applying voltage to the metal core bar. In a configuration in which the charger 27 includes a charging roller such as described above, the surface of the photosensitive member 1 can be charged via the resin layer in contact with the photosensitive member 1 as a result of the voltage applying section applying voltage to the metal core bar.

A resin for forming the resin layer of the charging roller is not limited specifically other than being capable of favorably charging the surface (circumferential surface) of the photosensitive member 1. Examples of resins for forming the resin layer include silicone resins, urethane resins, and silicone modified resins. The resin layer may optionally contain an inorganic filler.

In a configuration in which the image forming apparatus 6 includes a contact charger 27, the surface of the photosensitive member 1 is liable to be exposed to ions having high kinetic energy generated by gap discharge, when compared with a configuration in which the image forming apparatus 6 includes a non-contact charger 27. However, as has been already described, the minute gap width between the charger 27 and the photosensitive member 1 in the first embodiment tends to be secured even in the region where the photosensitive member 1 is in contact with the charger 27. As a result, the photosensitive member 1 in the first embodiment is hardly influenced by ions having high kinetic energy generated by gap discharge. Accordingly, the photosensitive member 1 can be easily charged to a desired potential of positive polarity in the charging step during a next rotation of the photosensitive member 1. As such, it is though that occurrence of transfer memory can be inhibited in the photosensitive member 1 and induction of a defect in image quality due to the presence of transfer memory transfer memory can be inhibited in the image forming apparatus 6 including the photosensitive member 1.

In a configuration in which the image forming apparatus 6 includes a contact charger 27, it is though that emission of active gases (for example, ozone and nitrogen oxide) generated from the charger 27 can be inhibited. As a result, degradation of the photosensitive layer 3 by the active gases can be inhibited and apparatus design can be enabled that takes into account use in an office environment.

No particular limitations are placed on the voltage applied by the charger 27. Examples of voltages that the charger 27 applies include an alternating current voltage, a superimposed voltage of an alternating current voltage superimposed on a direct current voltage, and a direct current voltage. Among the above voltages, the charger 27 preferably applies the direct current voltage. The charger 27 that applies only the direct current voltage is superior in the following aspects to a charger 27 that applies either of the direct current voltage and the superimposed voltage of an alternating current voltage superimposed on a direct current voltage. When the charger 27 applies only the direct current voltage, of which voltage value is constant, the surface of the photosensitive member 1 can be easily uniformly charged to a specific potential. In addition, when the charger 27 applies only the direct current voltage, an abrasion amount of the photosensitive layer 3 tens to reduce. As a result, formation of a favorable image is thought to enabled.

The voltage that the charger 27 applies is preferably at least 1,000 V and no greater than 2,000 V, more preferably at least 1,200 V and no greater than 1,800 V, and particularly preferably at least 1,400 V and no greater than 1,600 V.

The light exposure section 28 may for example be an exposure device and more specifically a laser scanning unit. The light exposure section 28 exposes the charged surface of the photosensitive member 1 to form an electrostatic latent image on the surface of the photosensitive member 1. Specifically, after the circumferential surface of the photosensitive member 1 has been uniformly charged by the charger 27, the light exposure section 28 irradiates the circumferential surface of the photosensitive member 1 with laser light based on image data input from a higher-level device such as a personal computer. Through the above, an electrostatic latent image based on the image data is formed on the circumferential surface of the photosensitive member 1.

The development section 29 develops the electrostatic latent image into a toner image. Specifically, the development section 29 forms a toner image based on the image data by supplying toner to the circumferential surface of the photosensitive member 1 once the electrostatic latent image has been formed thereon. The development section 29 may be a developing device, for example.

The transfer section (corresponding to the primary transfer rollers 33 and the secondary transfer roller 21) transfers the toner image formed on the surface of the photosensitive member 1 to a transfer target (corresponding to the intermediate transfer belt 20 and the paper P). The intermediate transfer belt 20 is an endless circulating belt. The intermediate transfer belt 20 is wound around a drive roller 30, a driven roller 31, a backup roller 32, and the primary transfer rollers 33. The intermediate transfer belt 20 is positioned such that circumferential surfaces of the photosensitive members 1 are each in contact with the surface (contact surface) of the intermediate transfer belt 20.

The intermediate transfer belt 20 is pressed against each of the photosensitive members 1 by a corresponding one of the primary transfer rollers 33 that is located opposite to the photosensitive member 1. The intermediate transfer belt 20 circulates endlessly in the arrowed direction (i.e., counterclockwise) by the drive roller 30 while in the pressed state. The drive roller 30 is rotationally driven by a drive source such as a stepper motor and imparts driving force on the intermediate transfer belt 20 that causes endless circulation of the intermediate transfer belt 20. The driven roller 31, the backup roller 32, and the primary transfer rollers 33 are freely rotatable. The driven roller 31, the backup roller 32, and the primary transfer rollers 33 passively rotate in accompaniment to endless circulation of the intermediate transfer belt 20 by the drive roller 30. The driven roller 31, the backup roller 32, and the primary transfer rollers 33 passively rotate through the intermediate transfer belt 20, in response to active rotation of the drive roller 30, while supporting the intermediate transfer belt 20.

The primary transfer rollers 33 apply a primary transfer bias (specifically, a bias of opposite polarity to that of the toner) to the intermediate transfer belt 20. As a result, toner images formed on the respective photosensitive members 1 are sequentially transferred (primary transfer) onto the intermediate transfer belt 20 as the intermediate transfer belt 20 circulates between the respective photosensitive members 1 and the corresponding primary transfer rollers 33. Note that the charging polarity of the toner is positive.

The secondary transfer roller 21 applies a secondary transfer bias (specifically, a bias of opposite polarity to that of the toner) to the paper P. As a result, the toner images that have been transferred onto the intermediate transfer belt 20 by primary transfer are transferred onto the paper P between the secondary transfer roller 21 and the backup roller 32. Through the above, unfixed toner images are transferred onto the paper P.

The fixing section 10 fixes to the paper P, the unfixed toner images that have been transferred onto the paper P by the image forming section 9. The fixing section 10 includes a heating roller 34 and a pressure roller 35. The heating roller 34 is heated by a conductive heating element. The pressure roller 35 is disposed opposite to the heating roller 34 and has a circumferential surface that is pressed against a circumferential surface of the heating roller 34.

The transferred images that have been transferred onto the paper P by the secondary transfer roller 21 in the image forming section 9 is subsequently fixed to the paper P through a fixing process in which the paper P is heated as the paper P passes between the heating roller 34 and the pressure roller 35. After the paper P has been subjected to the fixing process, the paper P is ejected to the paper ejection section 11. A plurality of conveyance rollers 36 are disposed at appropriate locations between the fixing section 10 and the paper ejection section 11.

The paper ejection section 11 is formed in a fashion that a top portion of the apparatus housing 7 is recessed. An exit tray 37 for receiving the ejected paper P is provided at the bottom of the recess. The image forming apparatus 6 according to an aspect of the present embodiment has been described so far with reference to FIG. 2.

Figure 3:
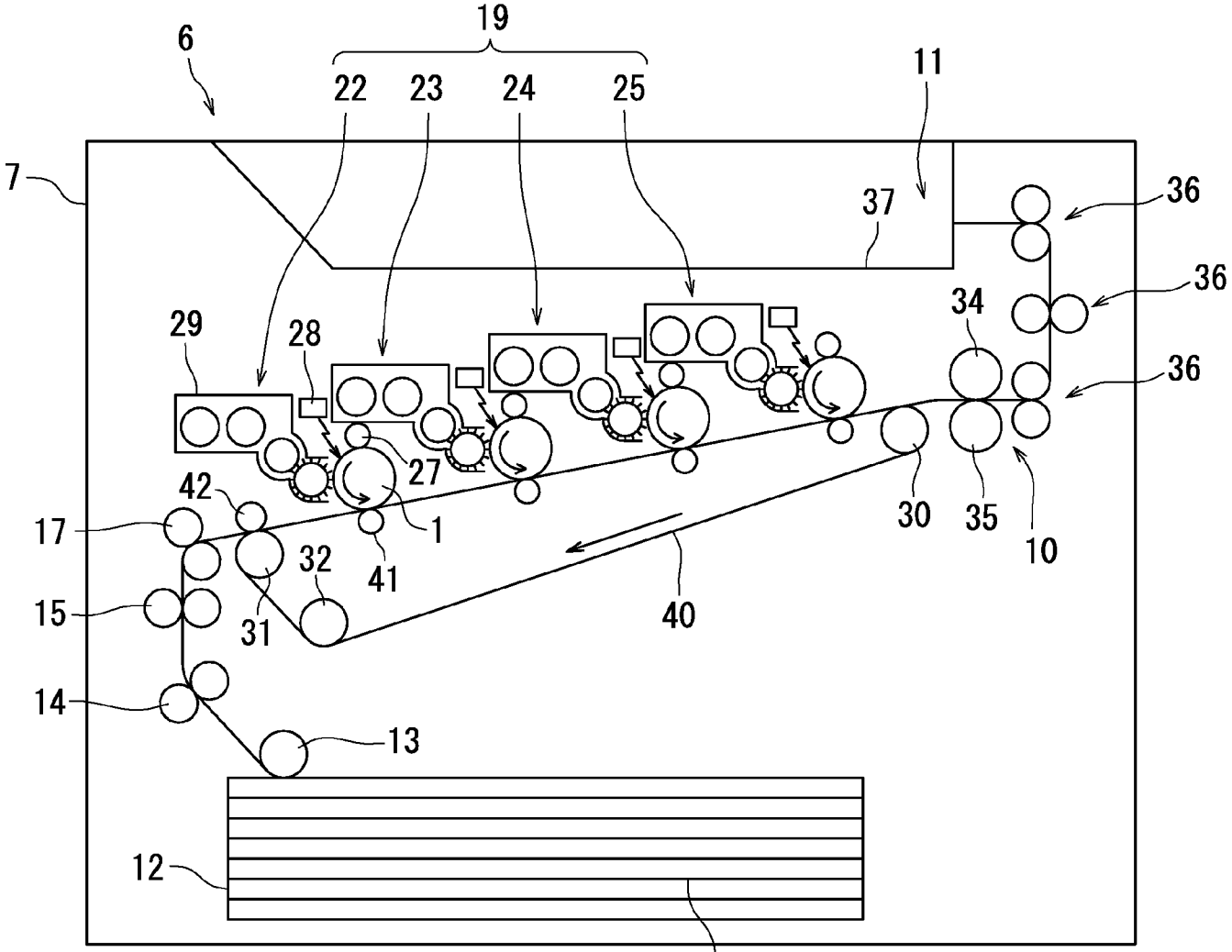
FIG. 3 roughly illustrates another example of the image forming apparatus according to the second embodiment of the present disclosure.

The following describes the image forming apparatus 6 according to an alternative aspect of the present embodiment with reference to FIG. 3. FIG. 3 roughly illustrates an alternative example of the image forming apparatus 6. The image forming apparatus 6 illustrated in FIG. 3 adopts the direct transfer process. In the image forming apparatus 6 illustrated in FIG. 3, the transfer section is equivalent to transfer rollers 41. Also, the transfer target is equivalent to a recording medium (for example, paper P). Elements in FIG. 3 that correspond to elements in FIG. 2 are labelled using the same reference signs and description thereof is not repeated.

A transfer belt 40 illustrated in FIG. 3 is an endless circulating belt. The transfer belt 40 is wound around the drive roller 30, the driven roller 31, the backup roller 32, and the transfer rollers 41. The transfer belt 40 is positioned such that the circumferential surfaces of the photosensitive members 1 are each in contact with the surface (contact surface) of the transfer belt 40. The transfer belt 40 is pressed against each of the photosensitive members 1 by the corresponding transfer roller 41 located opposite to the photosensitive member 1. The transfer belt 40 circulates endlessly while in a pressed state through the rollers 30, 31, 32, and 41. The drive roller 30 is rotationally driven by a drive source such as a stepper motor and imparts driving force that causes endless circulation of the transfer belt 40. The driven roller 31, the backup roller 32, and the transfer rollers 41 are freely rotatable. The driven roller 31, the backup roller 32, and the transfer rollers 41 are rotationally driven in accompaniment to endless circulation of the transfer belt 40 by the drive roller 30. The rollers 31, 32, and 41 passively rotate while supporting the transfer belt 40. Paper P supplied by the pair of registration rollers 17 is sucked onto the transfer belt 40 by a paper holding roller 42. The paper P sucked onto the transfer belt 40 passes between the photosensitive members 1 and the corresponding transfer rollers 41 as the transfer belt 40 circulates.

The transfer rollers 41 transfers the toner images from the respective photosensitive members 1 to the paper P. The photosensitive members 1 are in contact with the paper P in transfer of the respective images. Specifically, each of the transfer rollers 41 applies a transfer bias (specifically, a bias of opposite polarity to that of toner) to the paper P that is sucked onto the transfer belt 40. As a result, a toner image formed on each of the photosensitive members 1 is transferred onto the paper P as the paper P passes between the photosensitive members 1 and the corresponding transfer rollers 41. The transfer belt 40 is driven by the drive roller 30 to circulate in an arrow direction (i.e., clockwise). As the transfer belt 40 circulates, the paper P sucked onto the transfer belt 40 passes between the photosensitive members 1 and the corresponding transfer rollers 41 successively. As the paper P passes between the photosensitive members 1 and the corresponding transfer rollers 41, toner images of corresponding colors formed on the photosensitive members 1 are transferred onto the paper P successively such that the toner images are superposed on one another. After the above, the photosensitive members 1 continue to rotate and a next process is performed. Through the above, a description has been provided with reference to FIG. 3 for the image forming apparatus 6 according to the alternative example of the present embodiment in which the direct transfer process is adopted.

As has been described with reference to FIGS. 2 and 3, the image forming apparatus 6 according to the present embodiment includes the photosensitive members 1 that each are according to the first embodiment. Occurrence of transfer memory can be inhibited in the photosensitive members 1. In the configuration of the image forming apparatus 6 including the photosensitive members 1 in the present embodiment, induction of a defect in image quality due to the presence of transfer memory can be inhibited.

Third Embodiment: Process Cartridge

The third embodiment pertains to a process cartridge. The process cartridge is a cartridge used for image formation. A process cartridge according to the present embodiment corresponds to each of the yellow toner supply unit 25, the magenta toner supply unit 24, the cyan toner supply unit 23, and the black toner supply unit 22. The process cartridge includes the photosensitive member 1 according to the first embodiment. The process cartridge may be designed so as to be attachable to and detachable from the image forming apparatus 6 in the second embodiment. The process cartridge may include, in addition to the photosensitive member 1, for example, at least one of the charger 27, the light exposure section 28, the development section 29, and the transfer section (corresponding to the primary transfer rollers 33 and the secondary transfer roller 21 where the intermediate transfer process is adopted, or the transfer rollers 41 where the direct-transfer process is adopted) which are described in the second embodiment. The process cartridge may further include either or both a cleaner and a static eliminator.

The process cartridge according to the present embodiment has been described so far. The process cartridge according to the present embodiment includes the photosensitive members 1 that are each according to the first embodiment. Occurrence of transfer memory can be inhibited in the photosensitive member 1. Accordingly, induction of a defect in image quality due to the presence of transfer memory transfer memory can be inhibited in the process cartridge according to the present embodiment. In addition, the process cartridge is easy to be handled and therefore can be replaced easily and quickly together with the photosensitive member 1 in a situation in which sensitivity characteristics or the like of the photosensitive member 1 becomes impaired.

EXAMPLES

The following provides more specific description of the present disclosure through use of examples. Note that the present disclosure is not in any way limited to the scope of the examples.

<1. Materials of Photosensitive Member>

The following charge generating materials, hole transport materials, electron transport materials, binder resins, and plural types of particles are prepared as materials for formation of photosensitive layers of photosensitive members.

(Charge Generating Material)

Charge generating materials (X—$H_2$Pc) and (TiOPc) were prepared as charge generating materials. The charge generating material (X—$H_2$PC) was a metal-free phthalocyanine represented by formula (CG-1) described in the first embodiment. The charge generating material (X—$H_2$Pc) had a crystal structure of X-form.

The charge generating material (TiOPc) was a titanyl phthalocyanine having a crystal structure of Y-from that is represented by formula (CG-2) indicated in the first embodiment. The charge generating material (TiOPc) has thermoprofile (C) in which no peak appears in a range of at least 50° C., and no greater than 270° C. other than a peak accompanying vaporization of absorbed water and one peak appears in a range of at least 270° C., and no greater than 400° C. in a thermoprofile from DSC.

(Hole Transport Material)

The compounds (HT-1) to (HT-4) described in the first embodiment were prepared as hole transport materials. Compounds represented by respective formulas (HT-5) to (HT-8) were also prepared. Hereinafter, the compounds represented by formulas (HT-5) to (HT-8) may be referred to as compounds (HT-5) to (HT-8), respectively.

(HT-5)

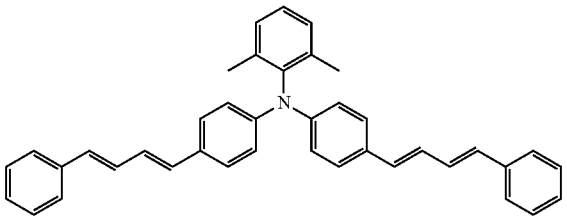

(HT-6)

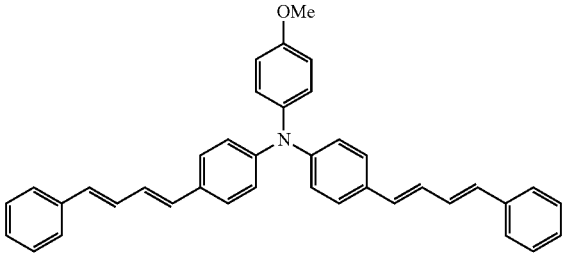

(HT-7)

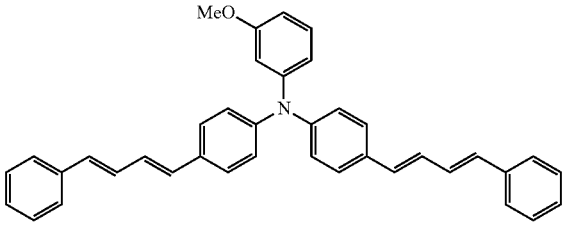

(HT-8)

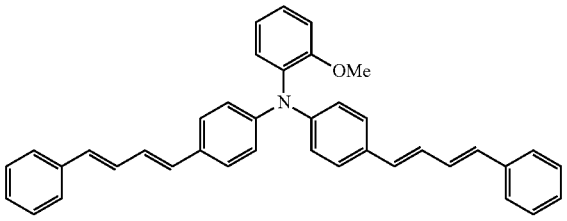

(Electron Transport Material)

The compounds (ET-1) to (ET-4) described in the first embodiment were prepared as electron transport materials.

(Binder Resin)

Binder resins (Resin-1a) to (Resin-8a) were prepared as binder resins.

The binder resins (Resin-1a) to (Resin-8a) were resins represented by formulas (Resin-1) to (Resin-8) described in the first embodiment, respectively. The binder resins (Resin-1a) to (Resin-8a) each have a viscosity average molecular weight of 50,000.

(Particles)

Nine types of particles (F1) to (F9) listed in Table 1 were prepared as particles. In Table 1, $D_{50}$ indicates a volume median diameter of particles. The volume median diameter means a median diameter calculated in terms of volume. The volume median diameters of the particles were measured using a precision particle size distribution analyzer (Coulter Counter Multisizer 3 produced by Beckman Coulter, Inc.). Note that "EPOSTAR", "Toraypearl", "AEROSIL", and "NanoTek" each are a registered Japanese trademark.

TABLE 1

| Particle | Type | | $D_{50}$ (μm) | Trade name | Manufacturer |
|---|---|---|---|---|---|
| F1 | Resin | Silicone resin | 0.70 | X-52-854 | Shin-Etsu Chemical Co., Ltd. |
| F2 | Resin | Silicone resin | 2.00 | KMP-590 | Shin-Etsu Chemical Co., Ltd. |
| F3 | Resin | Silicone resin | 5.00 | X-52-1621 | Shin-Etsu Chemical Co., Ltd. |
| F4 | Resin | Silicone resin | 0.50 | MSP-N050 | Nikko Rica Corporation |
| F5 | Resin | Melamine resin (melamine formaldehyde condensate) | 0.20 | EPOSTAR S | Nippon Shokubai Co., Ltd. |
| F6 | Resin | Benzoguanamine resin (benzoguanamine condensate) | 2.00 | EPOSTAR MS | Nippon Shokubai Co., Ltd. |
| F7 | Resin | Polyphenylene sulfide resin | 0.20 | Toraypearl PPS | Toray Industries, Inc. |
| F8 | Non-resin | Silica | 0.01 | AEROSIL RX200 | Nippon Aerosil Co., Ltd. |
| F9 | Non-resin | Alumina | 0.03 | NanoTek $Al_2O_3$ | C. I. Kasei Company, Limited |

<2. Photosensitive Member Production Method>

Photosensitive members (A-1) to (A-23) and (B-1) to (B-7) were produced using the materials for forming photosensitive layers of the respective photosensitive members prepared as above.

(Production of Photosensitive Member (A-1))

First, 5 parts by mass of the charge generating material (X—$H_2$Pc), 50 parts by mass of the compound (HT-1) as a hole transport material, 35 parts by mass of the compound (ET-1) as an electron transport material, 100 parts by mass of the binder resin (Resin-1a), 5 parts by mass of the particles (F1), and 800 parts by mass of tetrahydrofuran as a solvent were added into a vessel. The contents of the vessel ware mixed for dispersion for 50 hours using a ball mill to prepare an application liquid for photosensitive layer formation.

The application liquid for photosensitive layer formation was coated on a conductive substrate by dip coating to form an application film on the conductive substrate. Subsequently, the resultant application film was dried for 40 minutes at a temperature of 100° C. to remove tetrahydrofuran from the application film. Through the above, a photosensitive member (A-1) was produced. The photosensitive member (A-1) included a photosensitive layer having a thickness of 30 μm. The particles in the photosensitive member (A-1) has a content rate of 2.6% by mass relative to a total mass of the charge generating material, the hole transport material, the electron transport material, the binder resin, and the particles, that is, the total mass of the photosensitive layer.

(Production of Photosensitive Members (A-2) to (A-23) and (B-1) to (B-7))

The photosensitive members (A-2) to (A-23) and (B-1) to (B-7) were produced according to the same method as for the photosensitive member (A-1) in all aspects other than the followings. Charge generating materials (CGM), hole transport materials (HTM), electron transport materials (ETM), binder resins, and particles that are indicated in Tables 2-4 were used instead of the charge generating material (X—$H_2$Pc), the compound (HT-1) as a hole transport material, the compound (ET-1) as an electron transport material, the binder resin (Resin-1a), and the particle (F1) that were used in production of the photosensitive member (A-1). The additive amount of the particles was changed from 5 parts by mass in production of the photosensitive member (A-1) to those listed in Tables 2-4. Through the change in additive amount, the content rate of the particles was changed from 2.6% by mass in the photosensitive member (A-1) to those listed in Tables 2-4.

<3. Evaluation>

For each of the photosensitive members produced as above, sensitivity characteristics (residual potential $V_L$) and transfer memory potential were measured and images formed using the respective photosensitive members were evaluated. For the measurement of sensitivity characteristics (residual potential $V_L$) and transfer memory potential and image evaluation, the following evaluation apparatus and paper were used. Specifically, the evaluation apparatus was FS-C5250DN produced by KYOCERA Document Solutions Inc. The evaluation apparatus included a contact charger that applies direct current voltage. A charging roller used as the charger included a chargeable sleeve to charge the surface of a photosensitive member by being in contact with the photosensitive member. The chargeable sleeve was made from a chargeable rubber of epichlorohydrin resin in which a conductive carbon was dispersed. The evaluation apparatus adopted the intermediate transfer process. The paper used for evaluation was Brand Paper of KYOCERA Document Solutions, VM-A4 (A4 size) available at KYOCERA Document Solutions Inc. Measurement was performed under ambient conditions of 23° C., and 50% relative humidity.

(Sensitivity Characteristics (Residual Potential $V_L$))

Each of the photosensitive members was set in the evaluation apparatus. The photosensitive member was rotated at a peripheral speed of 100 rpm and changed using a drum sensitivity characteristics test device (product of GEN-TECH, INC.). The surface potential (initial potential $V_0$) of the photosensitive member was adjusted to +570V by adjusting the charging voltage that the charger applied to the photosensitive member. Next, monochromatic light (wavelength: 780 nm, half-width: 20 nm, light exposure amount: 0.5 μmJ/cm$^2$) was taken out from light of a halogen lamp using a bandpass filter. The surface of the photosensitive member was irradiated with (exposed under) the monochromatic light taken as above during one rotation. The surface potential (residual potential $V_L$, unit: +V) of the photosensitive member was measured when 50 milliseconds elapsed after irradiation with the monochromatic light. Note that the residual potential ($V_L$) having a smaller positive value indicates better sensitivity characteristics. The residual potentials $V_L$ measured as above are indicated in Tables 2-4.

<Transfer Memory Potential>

Each of the photosensitive members was set in the evaluation apparatus. The surface potential (initial potential $V_0$) of the photosensitive member was adjusted to +570V by adjusting the charging voltage that the charger applied to the photosensitive member. Subsequently, the surface potential ($V_{OFF}$, unit: +V) of a non-exposed portion of the photosensitive member was measured in a situation in which no transfer bias was applied to the photosensitive member. Then, the surface potential ($V_{ON}$, unit: +V) of the non-exposed portion of the photosensitive member was measured in a situation in which a transfer bias was applied to the photosensitive member. Note that the transfer bias applied to the photosensitive member was −2 KV.

A surface potential difference ($V_{ON}-V_{OFF}$) was calculated using the measured surface potentials ($V_{OFF}$ and $V_{ON}$). The calculated surface potential difference was taken to be a transfer memory potential. Transfer memory potentials that were calculated are shown in Tables 2-4. It should be noted that a transfer memory potential having a small absolute value indicates that transfer memory is inhibited from occurring.

(Image Evaluation)

Each of the photosensitive members was set in the evaluation apparatus. In order to stabilize the operation of the photosensitive member in the evaluation apparatus, an alphabet image was printed on the paper for one hour. Subsequently, an image A was printed on a sheet of the paper. The image A has a doughnut-shaped outlined pattern. The doughnut-shaped outlined pattern was composed of a pair of two concentric circles. An imaged portion of the image A (portion other than the doughnut-shaped outlined pattern) had an image density of 100%. The image A corresponded to a first rotation of the photosensitive member. Next, a halftone image B (image density 12.5%) was printed entirely over one sheet and was used as an evaluation image sample for an image ghost. The image B corresponded to a second rotation of the photosensitive member.

The resultant evaluation sample was visually observed to check the presence or absence of an image ghost originating from the image A. The visual observation herein means observation (unaided observation) with an unaided eye or observation (loupe observation) through a loupe (magnification: 10×, TL-SL10K produced by Trusco Nakayama Corporation). The presence or absence of an image ghost was evaluated in accordance with the following standard.

(Image Evaluation Standard)

Excellent: No image ghost was observed at all by unaided observation and loupe observation.

Good: No image ghost was confirmed by unaided observation but a slight image ghost was confirmed by loupe observation.

Mediocre: A slight image ghost was confirmed by unaided observation.

Poor: An image ghost was distinctly confirmed by unaided observation.

In Tables 2-4, CGM, HTM. ETM, and $V_L$ represent a charge generating material, a hole transport material, an electron transport material, and a residual potential, respectively.

TABLE 2

| | Material | | | | | | | | | |
|---|---|---|---|---|---|---|---|---|---|---|
| | | | | | Particles | | | | Transfer | |
| Photosensitive member | CGM Type | HTM Type | ETM Type | Binder resin Type | Type | Additive amount [part by mass] | Content rate [wt %] | $V_L$ [+V] | memory potential [V] | Image evaluation |
| A-1 | X-$H_2$Pc | HT-1 | ET-1 | Resin-1a | F1 | 5 | 2.6 | 107 | −18 | Excellent |
| A-2 | X-$H_2$Pc | HT-2 | ET-1 | Resin-1a | F1 | 5 | 2.6 | 102 | −23 | Good |
| A-3 | X-$H_2$Pc | HT-3 | ET-1 | Resin-1a | F1 | 5 | 2.6 | 103 | −26 | Good |
| A-4 | X-$H_2$Pc | HT-4 | ET-1 | Resin-1a | F1 | 5 | 2.6 | 106 | −16 | Excellent |
| A-5 | X-$H_2$Pc | HT-1 | ET-1 | Resin-1a | F2 | 5 | 2.6 | 102 | −17 | Excellent |
| A-6 | X-$H_2$Pc | HT-1 | ET-1 | Resin-1a | F3 | 5 | 2.6 | 99 | −15 | Excellent |
| A-7 | X-$H_2$Pc | HT-1 | ET-1 | Resin-1a | F4 | 5 | 2.6 | 103 | −18 | Excellent |
| A-8 | X-$H_2$Pc | HT-1 | ET-1 | Resin-1a | F5 | 5 | 2.6 | 106 | −21 | Excellent |
| A-9 | X-$H_2$Pc | HT-1 | ET-1 | Resin-1a | F6 | 5 | 2.6 | 107 | −17 | Excellent |
| A-10 | X-$H_2$Pc | HT-1 | ET-1 | Resin-1a | F7 | 5 | 2.6 | 106 | −23 | Good |

TABLE 3

| | Material | | | | | | | | Transfer | |
|---|---|---|---|---|---|---|---|---|---|---|
| | | | | | Particles | | | | memory | |
| Photosensitive member | CGM Type | HTM Type | ETM Type | Binder resin Type | Type | Additive amount [part by mass] | Content rate [wt %] | $V_L$ [+V] | potential [V] | Image evaluation |
| A-11 | X-$H_2$Pc | HT-1 | ET-1 | Resin-2a | F1 | 5 | 2.6 | 104 | −20 | Excellent |
| A-12 | X-$H_2$Pc | HT-1 | ET-1 | Resin-3a | F1 | 5 | 2.6 | 106 | −16 | Good |
| A-13 | X-$H_2$Pc | HT-1 | ET-1 | Resin-4a | F1 | 5 | 2.6 | 93 | −21 | Excellent |
| A-14 | X-$H_2$Pc | HT-1 | ET-1 | Resin-5a | F1 | 5 | 2.6 | 120 | −12 | Good |

TABLE 3-continued

| | Material | | | | | | | | Transfer | |
|---|---|---|---|---|---|---|---|---|---|---|
| | | | | | Particles | | | | memory | |
| Photosensitive member | CGM Type | HTM Type | ETM Type | Binder resin Type | Type | Additive amount [part by mass] | Content rate [wt %] | $V_L$ [+V] | potential [V] | Image evaluation |
| A-15 | X-$H_2$Pc | HT-1 | ET-1 | Resin-6a | F1 | 5 | 2.6 | 118 | −25 | Good |
| A-16 | X-$H_2$Pc | HT-1 | ET-1 | Resin-7a | F1 | 5 | 2.6 | 113 | −23 | Good |
| A-17 | X-$H_2$Pc | HT-1 | ET-1 | Resin-8a | F1 | 5 | 2.6 | 124 | −21 | Good |
| A-18 | X-$H_2$Pc | HT-1 | ET-2 | Resin-1a | F1 | 5 | 2.6 | 106 | −12 | Excellent |
| A-19 | X-$H_2$Pc | HT-1 | ET-3 | Resin-1a | F1 | 5 | 2.6 | 107 | −13 | Excellent |
| A-20 | X-$H_2$Pc | HT-1 | ET-4 | Resin-1a | F1 | 5 | 2.6 | 109 | −18 | Excellent |
| A-21 | X-$H_2$Pc | HT-1 | ET-1 | Resin-1a | F1 | 10 | 5.0 | 107 | −19 | Excellent |
| A-22 | X-$H_2$Pc | HT-1 | ET-1 | Resin-1a | F1 | 20 | 9.5 | 101 | −18 | Excellent |
| A-23 | TiOPc | HT-1 | ET-1 | Resin-1a | F1 | 5 | 2.6 | 94 | −24 | Good |

TABLE 4

| | Material | | | | | | | | Transfer | |
|---|---|---|---|---|---|---|---|---|---|---|
| | | | | | Particles | | | | | |
| Photosensitive member | CGM Type | HTM Type | ETM Type | Binder resin Type | Type | Additive amount [part by mass] | Content rate [wt %] | $V_L$ [+V] | memory potential [V] | Image evaluation |
| B-1 | X-$H_2$Pc | HT-1 | ET-1 | Resin-1a | None | None | None | 136 | −49 | Poor |
| B-2 | X-$H_2$Pc | HT-5 | ET-1 | Resin-1a | F1 | 5 | 2.6 | 147 | −51 | Poor |
| B-3 | X-$H_2$Pc | HT-6 | ET-1 | Resin-1a | F1 | 5 | 2.6 | 159 | −47 | poor |
| B-4 | X-$H_2$Pc | HT-7 | ET-1 | Resin-1a | F1 | 5 | 2.6 | 140 | −46 | Poor |
| B-5 | X-$H_2$Pc | HT-8 | ET-1 | Resin-1a | F1 | 5 | 2.6 | 142 | −44 | Poor |
| B-6 | X-$H_2$Pc | HT-1 | ET-1 | Resin-1a | F8 | 5 | 2.6 | 146 | −45 | Poor |
| B-7 | X-$H_2$Pc | HT-1 | ET-1 | Resin-1a | F9 | 5 | 2.6 | 132 | −35 | Mediocre |

As indicated in Tables 2 and 3, the photosensitive members (A-1) to (A-23) each had a small absolute value of transfer memory potential. The above shown that occurrence of transfer memory could be inhibited in these photosensitive members. These photosensitive members each had low residual potential $V_L$ and were excellent in sensitivity characteristics. Furthermore, these photosensitive members each had an excellent result of image evaluation. Through the above, it was shown that induction of a defect in image quality due to the presence of transfer memory could be inhibited in an image forming apparatus including any of these photosensitive members.

As indicated in Table 4, the photosensitive layer of the photosensitive member (B-1) did not contain the particles of the first resin. The photosensitive layers of the respective photosensitive members (B-2) to (B-5) did not contain the compound (1). The particles included in the photosensitive layers of the respective photosensitive members (B-6) and (B-7) were not formed by the first resin. For the above reasons, these photosensitive members each had a high absolute value of transfer memory potential. As a result, transfer memory occurred in these photosensitive members. Furthermore, these photosensitive members each had high residual potential $V_L$ and were poor in sensitivity characteristics. Yet, these photosensitive members each had an poor result of image evaluation.

In view of the foregoing, it was proved that occurrence of transfer memory could be inhibited in the photosensitive member according to the present disclosure. In addition, the above proved that induction of a defect in image quality due to the presence of transfer memory can be inhibited in an image forming apparatus including the photosensitive member.

What is claimed is:

1. A positively chargeable single-layer electrophotographic photosensitive member comprising a conductive substrate and a photosensitive layer, wherein the photosensitive layer contains at least a charge generating material, a hole transport material, and particles of a first resin, and a compound represented by general formula (1) shown below is contained as the hole transport material, (1)

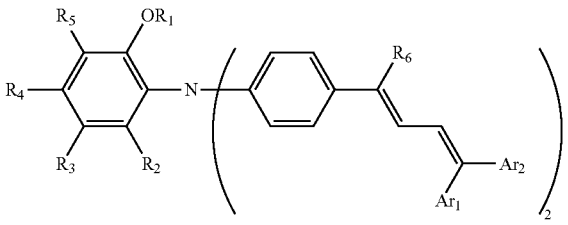

where, in the general formula (1), $R_1$ represents an alkyl group having a carbon number of 2 or 4, $R_3$, $R_5$, and $R_6$ each represent a hydrogen atom, $R_2$ and $R_4$ each represent, independently of each other, a hydrogen atom or an alkyl group having a carbon number of at least 1 and no greater than 4, and either one of $Ar_1$ and $Ar_2$ represents an aryl group having a carbon number of at least 6 and no greater than 20 and the other represents a hydrogen atom.

2. The positively chargeable single-layer electrophotographic photosensitive member according to claim 1, wherein the first resin is a silicone resin, a melamine resin, or a benzoguanamine resin.

3. The positively chargeable single-layer electrophotographic photosensitive member according to claim 1, wherein the particles of the first resin have a volume median diameter of at least 0.05 μm and no greater than 5.00 μm.

4. The positively chargeable single-layer electrophotographic photosensitive member according to claim 1, wherein the particles of the first resin have a content rate of no greater than 25.0% by mass relative to a total mass of the photosensitive layer.

5. The positively chargeable single-layer electrophotographic photosensitive member according to claim 1, wherein in the general formula (1), $R_1$ represents an alkyl group having a carbon number of 2, $R_2$, $R_3$, $R_5$, and $R_6$ each represent a hydrogen atom, $R_4$ represents a hydrogen atom or an alkyl group having a carbon number of at least 1 and no greater than 4, and either one of $Ar_1$ and $Ar_2$ represents an aryl group having a carbon number of at least 6 and no greater than 14 and the other represents a hydrogen atom.

6. The positively chargeable single-layer electrophotographic photosensitive member according to claim 1, wherein in the general formula (1), $R_1$ represents an alkyl group having a carbon number of 2, $R_2$ represents an alkyl group having a carbon number of at least 1 and no greater than 4, $R_3$, $R_4$, $R_5$, and $R_6$ each represent a hydrogen atom, and either one of $Ar_1$ and $Ar_2$ represents an aryl group having a carbon number of at least 6 and no greater than 14 and the other represents a hydrogen atom, or in the general formula (1), $R_1$ represents an alkyl group having a carbon number of 4, $R_2$, $R_3$, $R_4$, $R_5$, and $R_6$ each represent a hydrogen atom, and either one of $Ar_1$ and $Ar_2$ represents an aryl group having a carbon number of at least 6 and no greater than 14 and the other represents a hydrogen atom.

7. The positively chargeable single-layer electrophotographic photosensitive member according to claim 1, wherein the photosensitive layer further contains a second resin as a binder resin, and the second resin is represented by general formula (2) shown below,

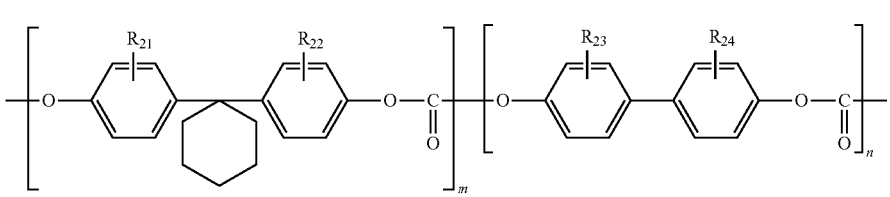

(2)

where, in the general formula (2), $R_{21}$, $R_{22}$, $R_{23}$, and $R_{24}$ each represent, independently of one another, a hydrogen atom or an alkyl group having a carbon number of at least 1 and no greater than 3, and $m+n=1.00$ and $0.00<m\leq1.00$.

8. The positively chargeable single-layer electrophotographic photosensitive member according to claim 7, wherein in the general formula (2), $R_{21}$ and $R_{22}$ each represent a hydrogen atom, and $m=1.00$ and $n=0.00$.

9. The positively chargeable single-layer electrophotographic photosensitive member according to claim 7, wherein in the general formula (2), $R_{21}$ and $R_{22}$ each represent, independently of each other, a hydrogen atom or an alkyl group having a carbon number of at least 1 and no greater than 3, $R_{23}$ and $R_{24}$ each represent a hydrogen atom, and $m+n=1.00$ and $0.50<m\leq0.70$.

10. The positively chargeable single-layer electrophotographic photosensitive member according to claim 1, wherein the photosensitive layer further contains an electron transport material, and the electron transport material is represented by general formula (3), (4), (5), or (6) shown below,

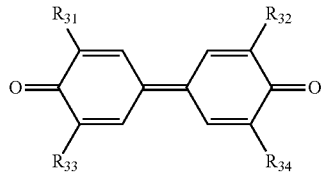

(3)

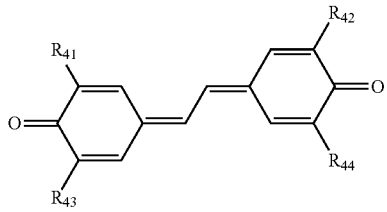

(4)

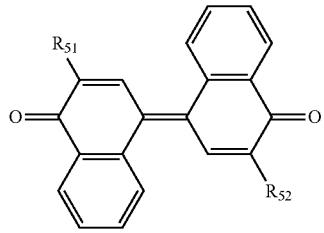

(5)

-continued (6)

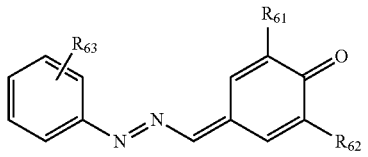

where, in the general formulas (3), (4), (5), and (6), $R_{31}$, $R_{32}$, $R_{33}$, $R_{34}$, $R_{41}$, $R_{42}$, $R_{43}$, $R_{44}$, $R_{51}$, $R_{52}$, $R_{61}$, and $R_{62}$ each represent, independently of one another, a hydrogen atom, an optionally substituted alkyl group, an optionally substituted alkenyl group, an optionally substituted alkoxy group, an optionally substituted aralkyl group, an optionally substituted aryl group, or an optionally substituted heterocyclic group, and $R_{63}$ represents a halogen atom, a hydrogen atom, an optionally substituted alkyl group, an optionally substituted alkenyl group, an optionally substituted alkoxy group, an optionally substituted aralkyl group, an optionally substituted aryl group, or an optionally substituted heterocyclic group.

11. The positively chargeable single-layer electrophotographic photosensitive member according to claim 10, wherein in the general formulas (3), (4), (5), and (6), $R_{31}$, $R_{32}$, $R_{33}$, $R_{34}$, $R_{41}$, $R_{42}$, $R_{43}$, $R_{44}$, $R_{51}$, $R_{52}$, $R_{61}$, and $R_{62}$ each represent, independently of one another, an alkyl group having a carbon number of at least 1 and no greater than 5, and $R_{63}$ represents a halogen atom.

12. The positively chargeable single-layer electrophotographic photosensitive member according to claim 1, which is used as an image bearing member in an image forming apparatus including a charger that applies direct current voltage to the image bearing member while in contact with the image bearing member.

13. A process cartridge comprising the positively chargeable single-layer electrophotographic photosensitive member according to claim 1.

14. The positively chargeable single-layer electrophotographic photosensitive member according to claim 1, wherein the compound represented by the general formula (1) is a compound represented by formula (HT-1), (HT-2), (HT-3), or (HT-4) shown below.

(HT-1)

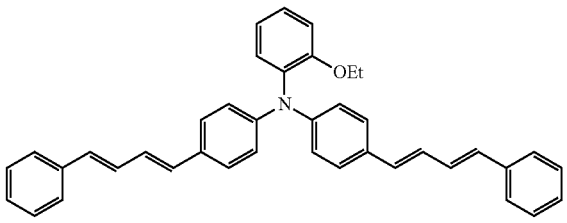

-continued (HT-2)

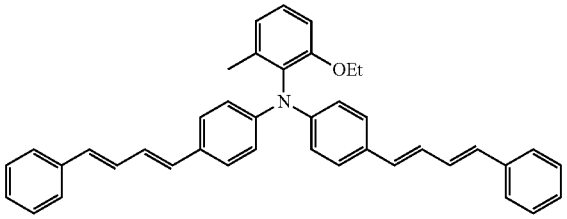

(HT-3)

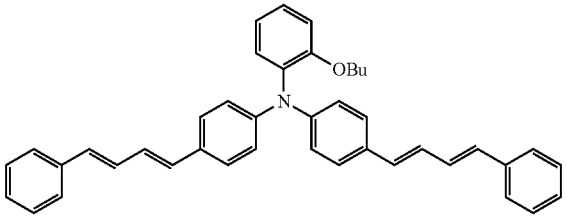

(HT-4)

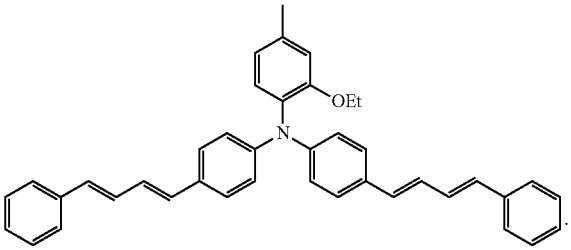

15. The positively chargeable single-layer electrophotographic photosensitive member according to claim 1, wherein the first resin is a benzoguanamine resin.

16. The positively chargeable single-layer electrophotographic photosensitive member according to claim 1, wherein the photosensitive layer further contains an electron transport material, and the electron transport material is represented by formula (ET-3) or (ET-4) shown below.

(ET-3)

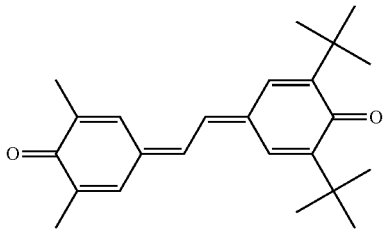

(ET-4)

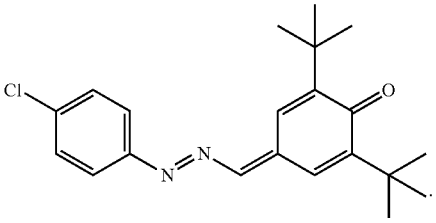

17. An image forming apparatus, comprising:

an image bearing member;

a charger that charges a surface of the image bearing member;

a light exposure section that exposes the charged surface of the image bearing member with light to form an electrostatic latent image on the surface;

a development section that develops the electrostatic latent image into a toner image; and a transfer section that transfers the toner image onto a transfer target from the image bearing member, wherein the charger positively charges the surface of the image bearing member, and the image bearing member is the positively chargeable single-layer electrophotographic photosensitive member according to claim 1.

18. The image forming apparatus according to claim 17, wherein the charger applies direct current voltage to the image bearing member while in contact with the image bearing member.

* * * * *